United States Patent [19]

Kinzbach

[11] 4,346,629

[45] Aug. 31, 1982

[54] TONG ASSEMBLY

[75] Inventor: Robert B. Kinzbach, Houston, Tex.

[73] Assignee: Weatherford/Lamb, Inc., Houston, Tex.

[21] Appl. No.: 145,905

[22] Filed: May 2, 1980

[51] Int. Cl.[3] ..... B25B 17/00

[52] U.S. Cl. ..... 81/57.2; 81/57.15

[58] Field of Search ..... 81/57.15, 57.16, 57.18, 81/57.2, 57.21

[56] References Cited

U.S. PATENT DOCUMENTS

| | | | |
|---|---|---|---|
| 2,550,045 | 4/1951 | De Hetre | 81/57.18 |
| 2,703,221 | 3/1955 | Gardner | 81/57.18 |
| 3,261,241 | 7/1966 | Catland | 81/57.18 |
| 3,518,903 | 7/1970 | Ham et al. | 81/57.16 |
| 4,170,907 | 10/1979 | Cathcart | 81/57.15 |
| 4,215,602 | 8/1980 | Carstensen et al. | 81/57.18 |

*Primary Examiner*—James L. Jones, Jr.

*Attorney, Agent, or Firm*—Guy McGlung

[57] ABSTRACT

A tong assembly for use in making-up and breaking-out joints of varying diameter. The tong assembly includes a housing, a carrier element, at least one jaw, a link corresponding to each jaw and pivotably connected to the carrier element and to which the corresponding jaw is pivotably connected, a drag device, and a brake. A power device may be connected to the tong assembly to drive the tong and a backup tong may be secured relative to the housing and to the power device of the tong assembly.

8 Claims, 75 Drawing Figures

Fig. 3
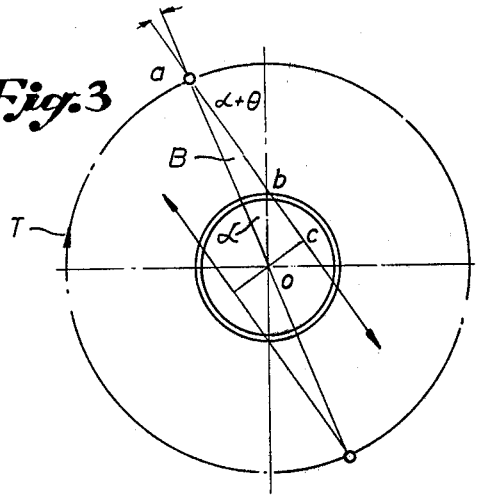
Fig. 4
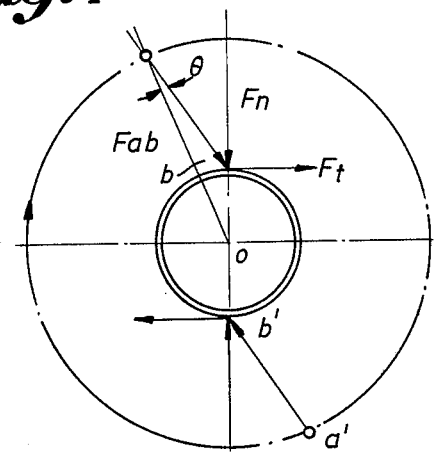
Fig. 5
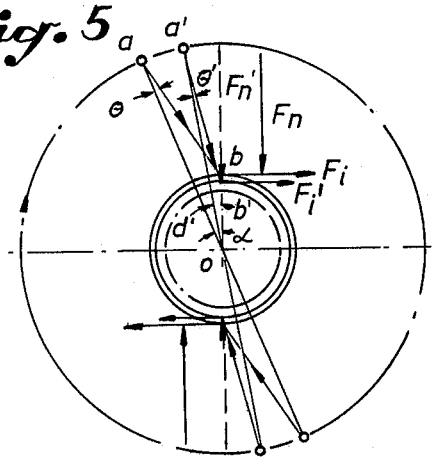
Fig. 6
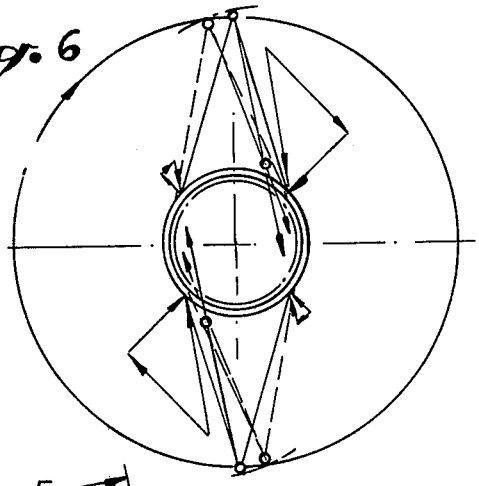
Fig. 7
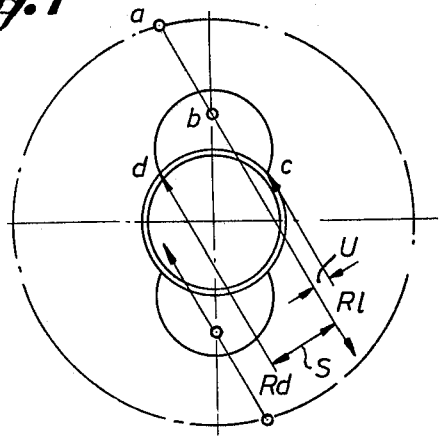
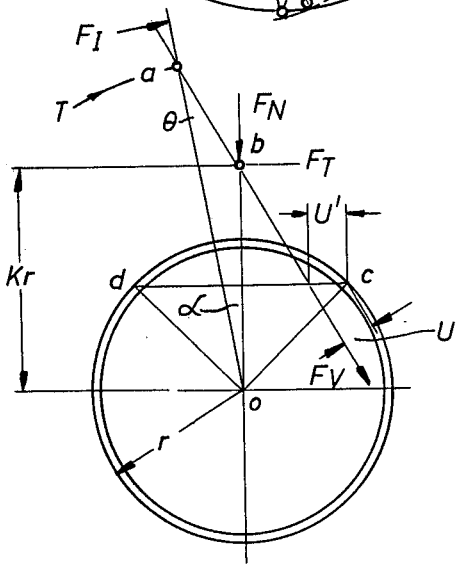
Fig. 8

Fig.15
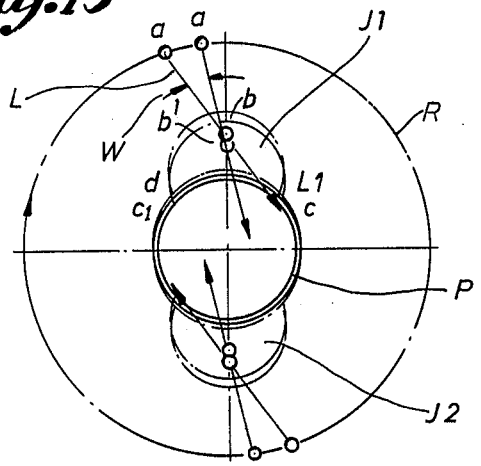
Fig.16
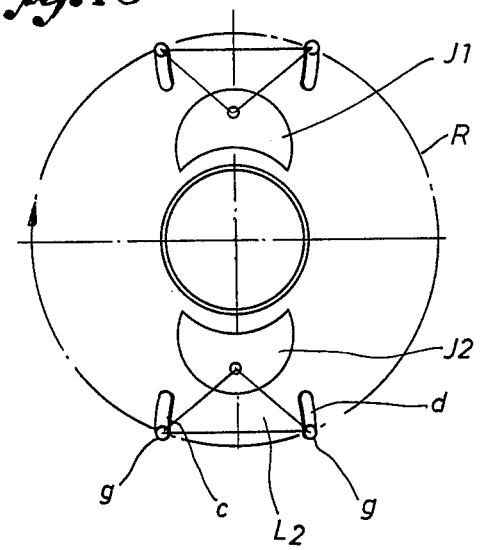
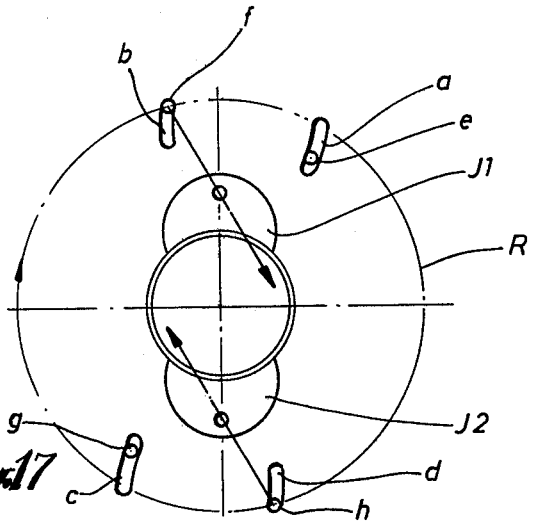
Fig.17
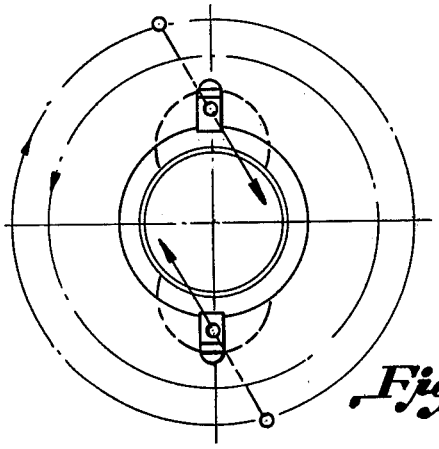
Fig.18
Fig.19
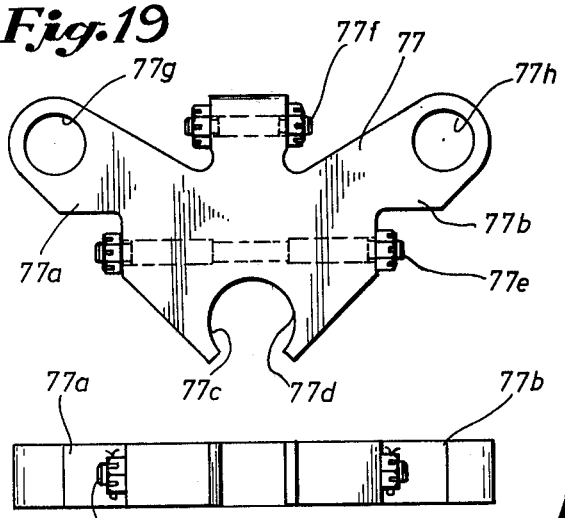
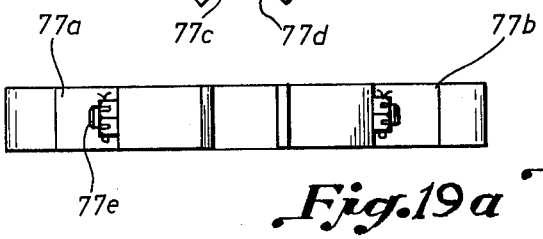
Fig.19a
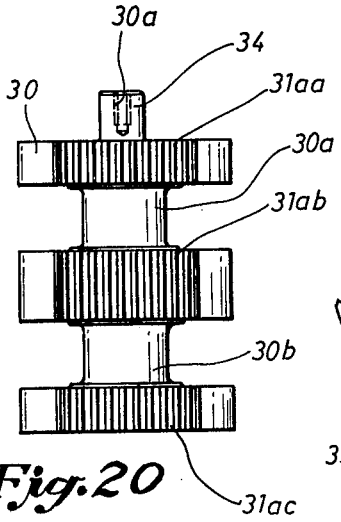
Fig.20
Fig.21
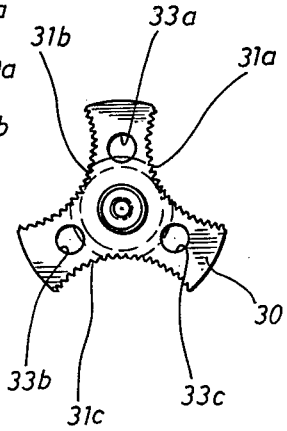

Fig. 36a
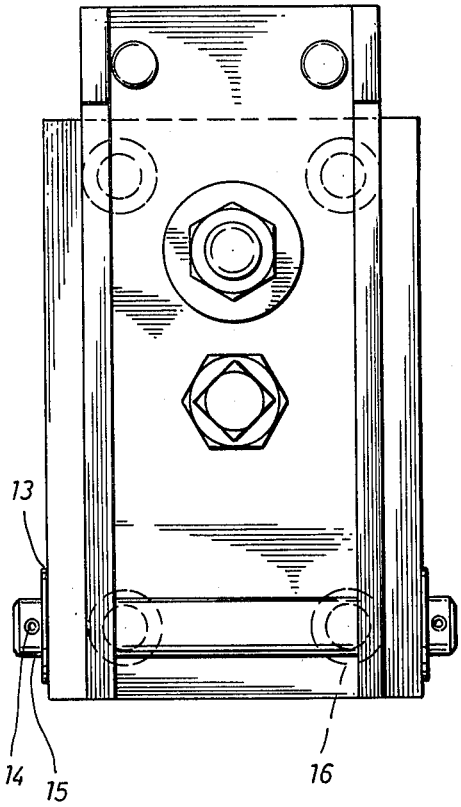
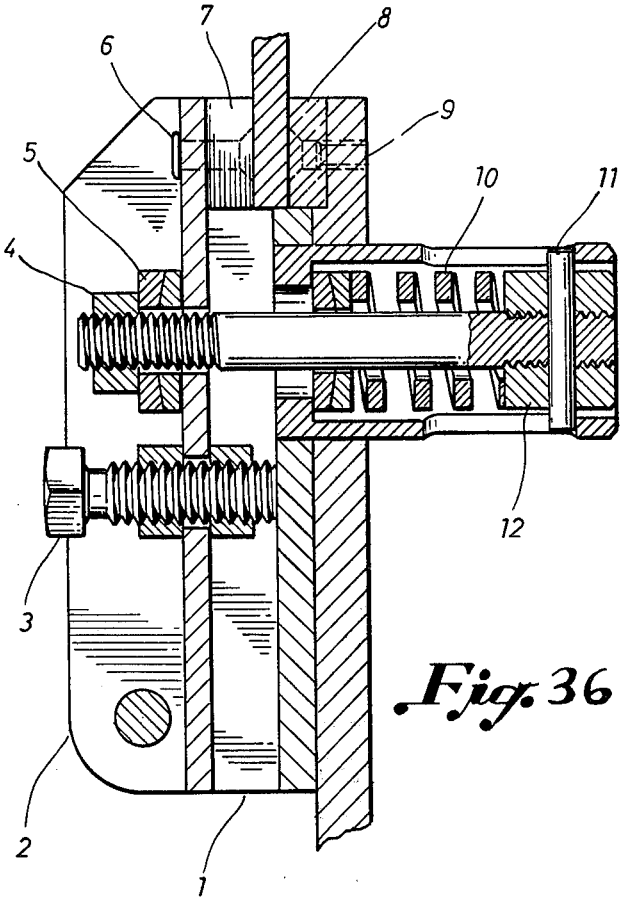
Fig. 36
Fig. 22a
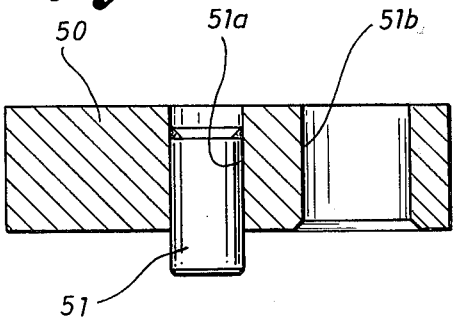
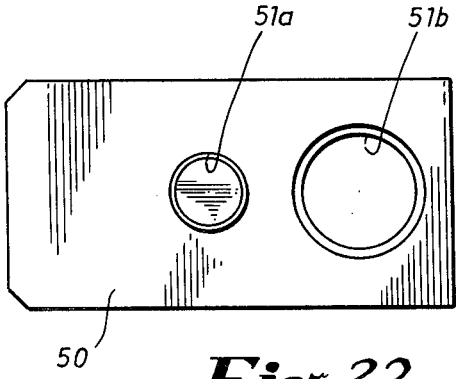
Fig. 22
Fig. 23
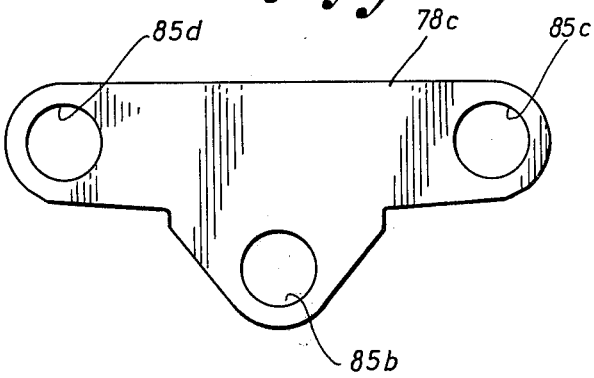
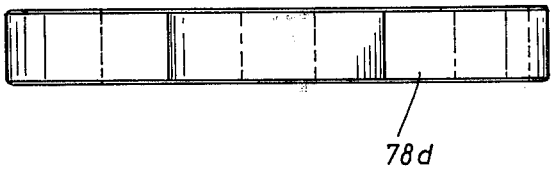
Fig. 23a Fig.24
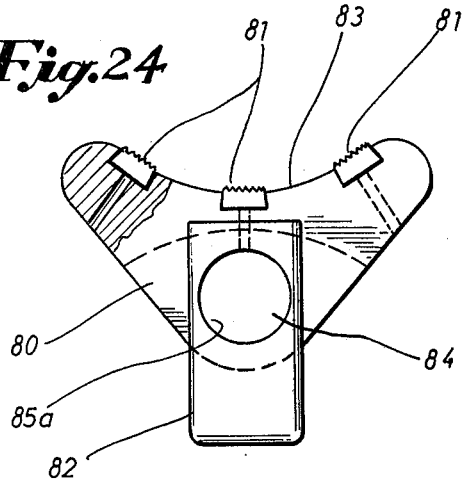
Fig.24a
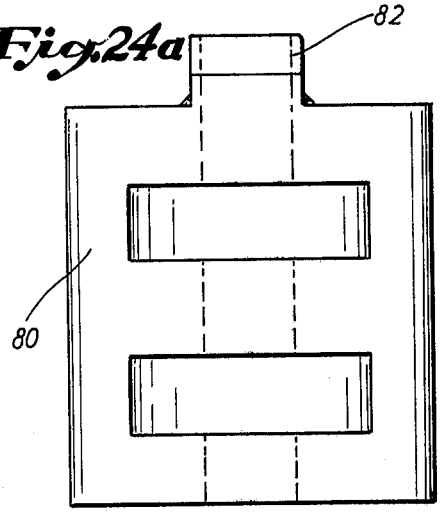
Fig.45
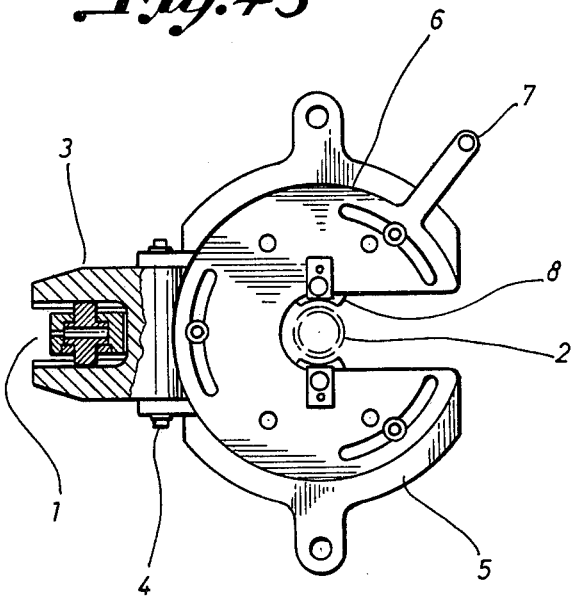
Fig.26
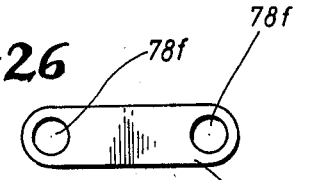
Fig.26a
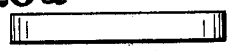
Fig.25
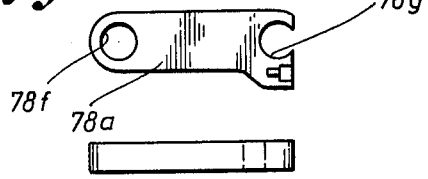
Fig.25a
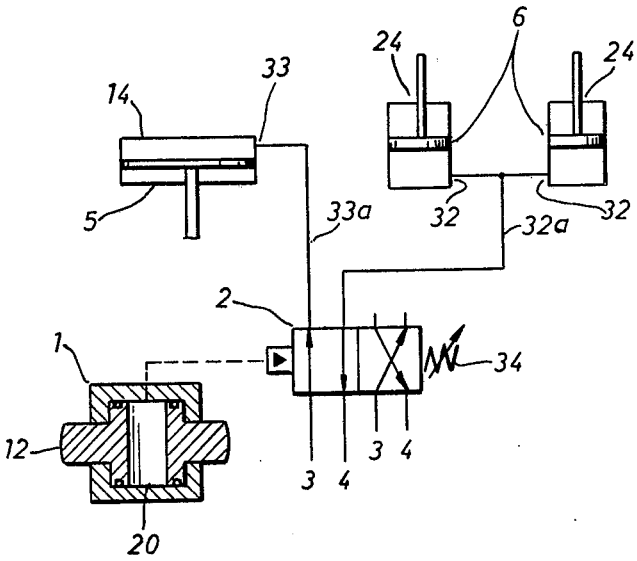
Fig.46

Fig. 29
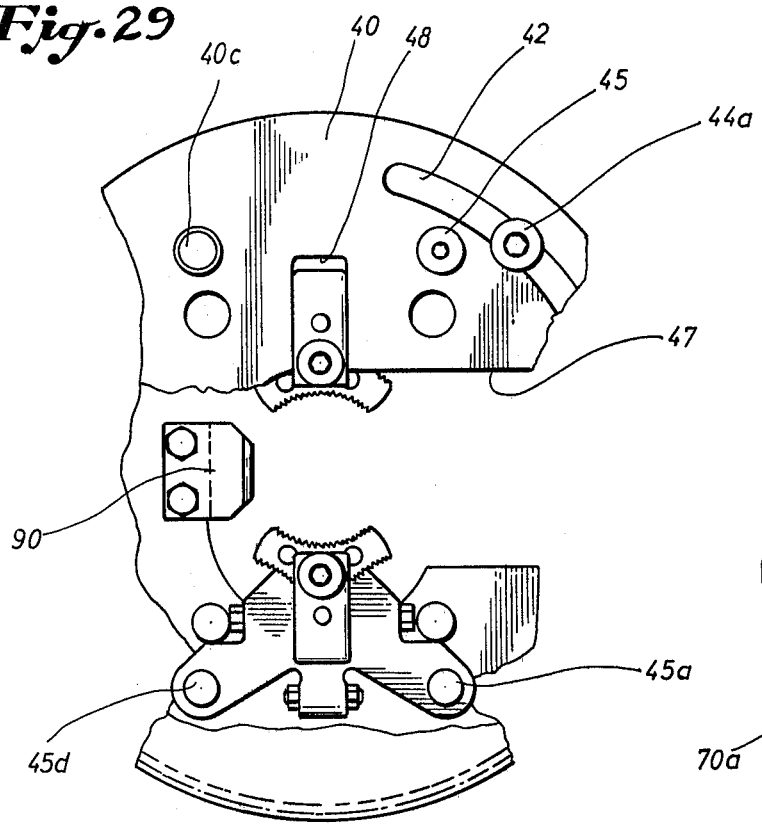
Fig. 29a
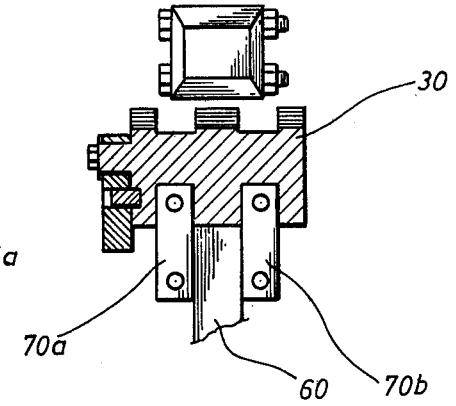
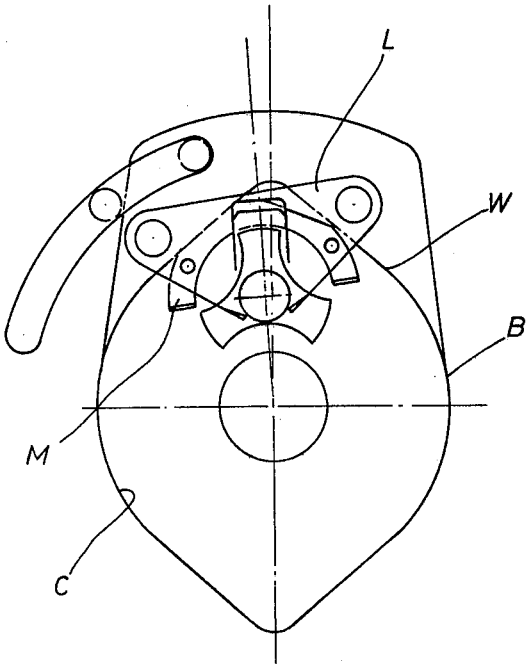
Fig. 30
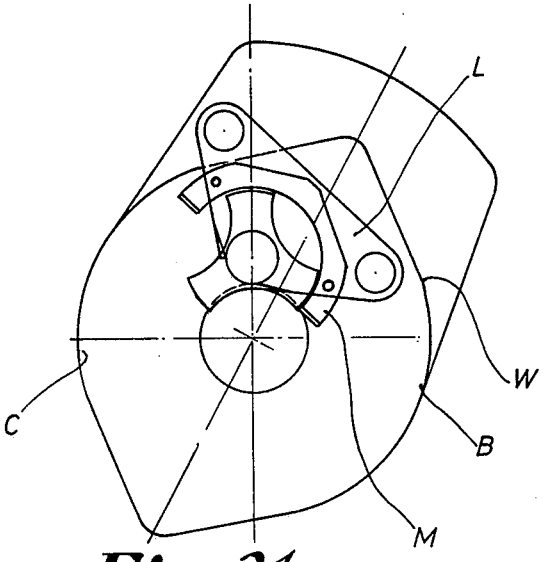
Fig. 31

Fig. 34
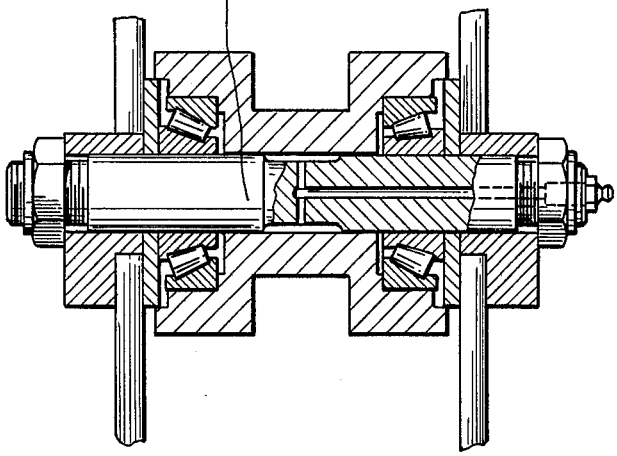
Fig. 34a
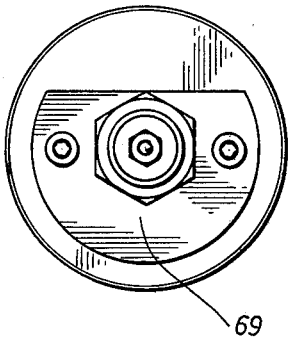
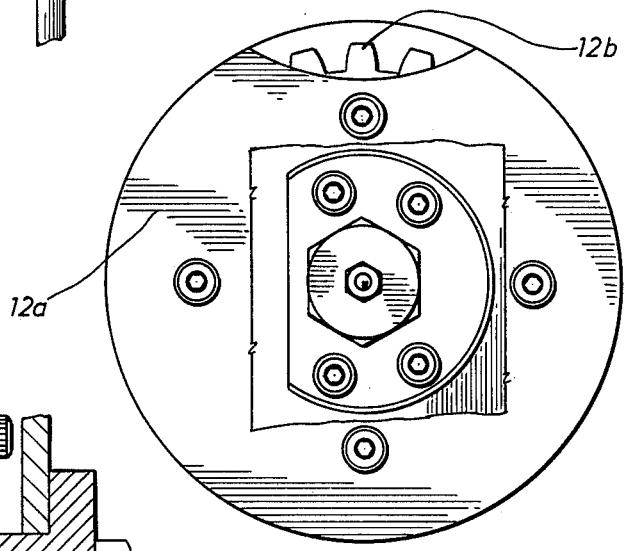
Fig. 35a
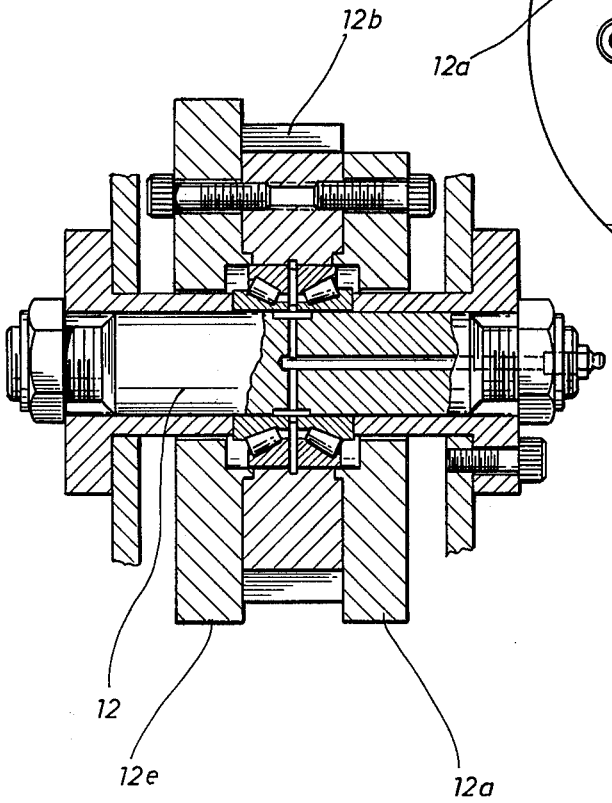
Fig. 35

Fig. 39a
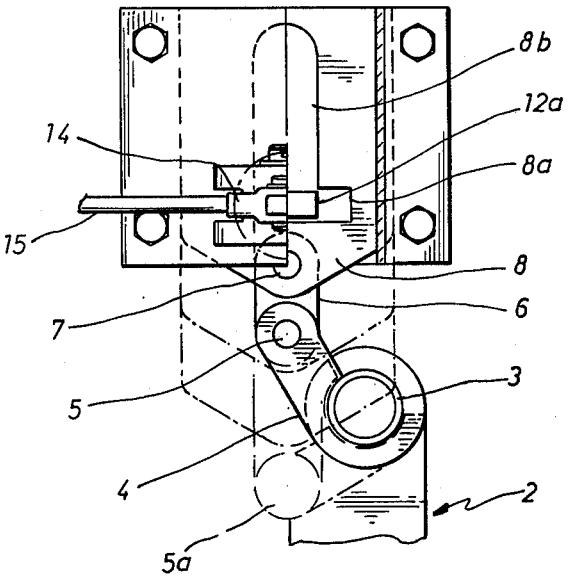
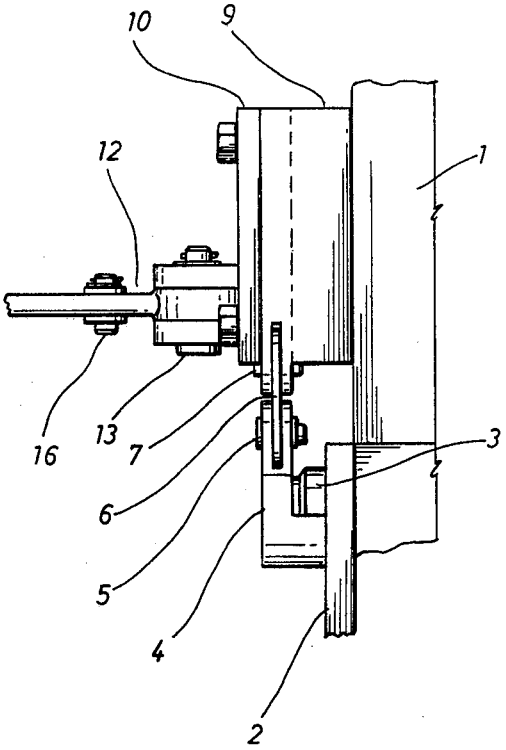
Fig. 39b
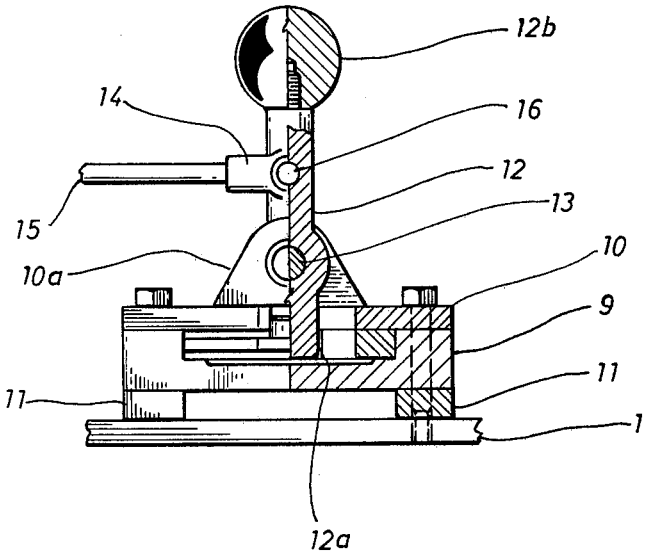
Fig. 39

SINGLE ACTIVE JAW RETRACTED

ENGAGED FOR CLOCKWISE ROTATION

ENGAGED FOR CTR. CLOCKWISE ROTATION

TWO ACTIVE JAWS RETRACTED

ENGAGED FOR CLOCKWISE ROTATION

ENGAGED FOR CTR. CLOCKWISE ROTATION

THREE ACTIVE JAWS RETRACTED

ENGAGED FOR CLOCKWISE ROTATION

ENGAGED FOR CTR. CLOCKWISE ROTATION

TONG ASSEMBLY

BACKGROUND OF THE INVENTION

1. Field of the Invention

This invention relates to the field of tongs, of the type commonly used for making up, and breaking apart, threaded connection between tubular member and the like.

2. Description of the Prior Art

Four categories of threaded joint tubular members, or rod elements are used in well drilling and production: casing, drill pipe, tubing and sucker rods. Available in incremental lengths, these members must be successively joined and lowered into the well or, conversely, separated and removed therefrom. Joint sections generally are circular, and the tubulars have no provision for keyed type engagement with a tong mechanism. The joint grip mechanism of a tong translates a rotative input force into coplanar vector forces, acting chordally across the joint section. At the points of grip contact with the joint surface, these chordal forces are resolved into normal and tangential components relative to the joint contour. Consequently, the rotative torque delivery capability of the tong system is a function of the normal component of the chordal vector multiplied by the coefficient of drag at the joint contact points of the grip elements.

The coefficient of drag is similar to the coefficient of friction, but includes the effects of friction plus shear plane interferences incident to surface irregularities and the impression of the grip element into the joint surface. Grip elements can be provided with multiple serrations, or penetration features, to provide the interference contact needed at the joint surface for the development of a suitably high coefficient of drag. Since torque delivery capability is a function of the normal force times the drag coefficient times the radius of the joint to be worked, the required magnitude of the normal force varies inversely with the coefficient of drag developed at the contact between the grip elements and the joint surface. The progressive refinement of tubular installation procedures and use practices, has mandated limitation and control of grip element penetrations into the joint surface. Consequently, the distribution and balance of grip element energizing forces are critical factors in the design, development and evaluation of a tong mechanism; while the effective diametrical range of grip capability is limited by the slope of the actuating force vector and the coefficient of drag at grip points.

Various mechanisms involving linkages, levers, wedges, and cams are in current use for the disposition and balance of the normal and tangential force components. Usually, grip elements, or dies, are arcuately disposed within carrier bodies, or jaws, which span a circumferential segment of the joint surface. These jaws are structured to accept the translated input chordal vector and deliver it to the joint surface in normal and tangential components. A degree of compromise must be established to accommodate acceptable ranges of joint and mechanism dimensional tolerance.

Design compromises, common to the art, structure jaws to operate with very high load variations between leading and trailing dies, or resort to jaw guiding slides, or linkages, to control die contact and tangential force delivery ratios. However, all jaw guides absorb energy and detract from torque delivery. Also, extremely uneven die loading causes excessive marring, or damage, to the joint surface.

A very prevalent compromise in tong design is the continuation of a counter-reactive brake force after jaw engagement has been established. This is necessary for those linkage types that are not self-energizing; that is, those that will not automatically respond to increase of input force by tightening grip on the joint. The net result of the brake action is a proportionate reduction of the torque delivered.

Prior art discloses two elementary mechanisms for the translation of rotative force from a torque input member to a joint surface, namely:

1. The pivoted solid bar, as shown diagrammatically in FIG. 3, and disclosed in practice in the U.S. Pat. No. 1,811,666.
2. The solid bar in combination with a cam track connection to the torque input member, as disclosed in U.S. Pat. No. 3,023,651 and shown diagrammatically in FIG. 6.

In the development of the art, various supplementary positioning and guiding options have been applied in an attempt to enhance the effectiveness of the grip systems. Each of these elementary mechanisms represents design compromises in the prior art which detract from tong effectiveness.

The pivoted solid bar mechanism requires an arcuate surface so that its camming action is effective; but since the surface is arcuate, there is line contact with the joint surface. Line contact with the joint surface increases the hazard of joint scoring or crushing due to the contact pressure developed.

The second elementary mechanism is the combination of a solid bar having multiple joint engaging elements and a cam follower which follows a cam track in the tong. Characteristically, the developed contact force will be uneven from contact point to contact point; i.e., the cam track mechanism spreads grip element die contact circumferentially on the joint, but tends to load the forward die increasingly as the link or bar elements tends to roll with the rotary force.

Various systems utilizing all or parts of these basic mechanisms are currently in use. For example, the Hillman-Kelly tong disclosed in U.S. Pat. No. 2,703,221, having a pivotably fixed jaw and a jaw actuated by a lever element which is pivotally and stationarily connected to a draw head. In the Weatherford GMBH tong disclosed in U.S. Pat. No. 4,192,206, a lever element pivotally connected to a carrier member receives input force through a cam section, the lever element having pivotally connected thereto a rocker jaw.

There are also in common usage various modifications of these basic mechanisms. All of these systems are subject to the same limitations and range considerations as those of the basic mechanisms.

SUMMARY OF THE INVENTION

The present invention is directed to a tong assembly having a housing, a carrier or rotary element, a counter-reactive brake means one or more pivotable rocker jaws, a toggle link corresponding to each jaw, and one or more brakes. Each rocker jaw, according to the present invention, is pivotally connected to a toggle link, and each toggle link is pivotally connected to the rotary element to produce the effective translation of rotative torque into a directed force vector within controlled limits to effect the efficient rotation of the joint. The present invention teaches a pivotable solid jaw which minimizes the radial distance from the jaw pivot point to the joint surface. The drag plate co-acts with the toggle links, jaws, and brake to rotate the jaws towards or away from the center of the joint to be worked while maintaining the radial symmetry of the jaws in relation to the joint. A power means may be provided to drive the tong assembly and a backup tong may be secured relative to the tong assembly and power means. Torque responsive means may be provided between the backup tong and the power means for shifting clutch means of the power means in response to torque changes.

It is, therefore, an object of the present invention to provide an efficient tong assembly.

Another object of the present invention is the provision of a tong assembly having a rotatable carrier element and one or more rocker jaws in combination with, and pivotally connected to a toggle link which link is pivotally connected to the rotary element.

Yet another object of the present invention is the provision of such a tong assembly in which each jaw has grip faces and is pivotally connected to its corresponding toggle link at a radial distance from the center of the joint to be worked so that the force vector of the force translated through the jaw to torque the joint is directed to chordally intersect with the joint contour within the arc subtended by the grip faces of the jaw within a predetermined angular range.

A further object of the present invention is the provision of such a tong assembly in which each of the one or more rocker jaws is pivoted about a point as near the joint surface as is structurally feasible thereby minimizing the radial distance of said pivot point from the joint surface to maximize the diametrical range of grip action.

A still further object of the present invention is the provision of a tong assembly designed so that it introduces a chordal force from the pivot point of the toggle link on the rotary section, through the pivot point of the toggle link and the jaw, and dividing the span of the jaw reaction points with the joint according to a predetermined ratio of reaction moments.

An additional object of the present invention is the provision of a tong assembly having intermediate toggle links pivoted between the carrier or rotary element and each of the one or more rocker jaws, the links spaced to convey balanced input rotative forces from the carrier or rotary element to the rocker jaws in a chordal direction relative to the joint contour.

Another object of the present invention is the provision of a tong assembly having pivotable jaws whose resultant reacting forces provide a stable load condition without utilizing additional force directing elements.

Yet another object of the present invention is the provision of toggle links which are segmented for assembly about the rocker jaw.

A further object of the present invention is the provision of segmented toggle links which may be placed in bolted assembly with the rocker jaw by means of an arcuate spacer which bridges the segmenting plane and faces the links for axial registry with the jaws.

A still further object of the present invention is the provision of a tong having such arcuate spacers which are contoured to provide a toggle angle limiting stop upon contact with a cavity in the rotary element wall.

Another object of the present invention is the provision of a drag plate means which maintains the jaw or jaws of a tong in symmetrical position relative to the joint contour and which maintains the jaws of a multi-jaw tong in opposed symmetrical position relative to the joint axis.

Yet another object of the present invention is the provision of a tong assembly having a drag plate mechanism which coacts with the jaw mechanisms to rotate the jaws towards or away from the center of the joint to be worked and which, if multiple jaws are provided, maintains radial symmetry of the jaws in relation to the joint.

A further object of the present invention is the provision of such a tong assembly having at least one solid jaw which permits the minimization of the radial distance between the joint wall and the pivot point of the jaw.

A still further object of the present invention is the provision of a solid jaw having multiple sets of grip faces selectively indexable into operational orientation.

An additional object of the present invention is the provision of a tong assembly having a rocker jaw system and intermediate toggle links which are spaced to convey balanced forces from the rotary input to the circumferentially spaced jaws at their pivot points so that as the jaws are moved into contact with the joint, the line of force from the toggle link connection to the rotary element to the pivot center of the jaw must extend chordally across the circle of joint contour within acceptable limits of angularity.

Yet another object of the present invention is the provision of a tong assembly having a self-energizing grip system delivering controlled energizing pressures to the grip elements with no counter-reactive force required after contact is established between the grip element and the joint surface.

Another object of the present invention is the provision of a tong assembly having freely pivoted grip element carriers which can simultaneously conform with the joint contour while urging the tong head into concentric disposition about the joint.

Yet another object of the present invention is the provision of a tong assembly having rocker jaws pivotally mounted to toggle links which are in turn pivotally mounted to the tong's rotary element so that balanced forces are delivered at the joint contact points thereby limiting the normal pressures on rotatively leading grip contact elements.

Another object of the present invention is the provision of a tong assembly which will minimize damage to the joint to be worked.

Another object of the present invention is the provision of a tong assembly in which damage to the grip elements of the tong will be reduced, and will therefore have greatly increased service life.

Another object of the present invention is the provision of a tong assembly in which concentricity between the joint and the tong is developed, and maintained.

Yet another object of the present invention is the provision of a tong assembly in which once the rocker jaws have reached pressured engagement with the joint to be worked, no braking mechanism is necessary and the jaw grip tightens in response to load.

A particular object of the present invention is the provision of a tong including a caliper-type brake having a pressure responsive mechanism to effect the release of the brake applied to the drag mechanism when the tong is under a load.

Another particular object of the present invention is the provision of a tong assembly having a drag mechanism having jaw orienting guides to maintain the aspect of the jaw grip surfaces with respect to the joint contour.

Another object of the present invention is the provision of brake means which are initially actuated into engagement with the drag brake to cause placing the jaws into a gripping relationship with a joint or in a retracted position. Furthermore, the brake is provided with means for disengaging the brake when the jaws are in a torqued gripping engagement with the joint. Still a further object is the provision of means for increasing tong efficiency by releasing the drag brake when the jaws of the tong are in a seated gripping position in which the brake may be released responsive to upstream pressure increase as the torque builds up or to downstream pressure decrease when the torque loading occurs.

Another object of the present invention is the provision of idler gears positioned on the tong for engagement by a power module and in turn engage the rotary in which the idler gears include flanges to act as supplementary guide rollers for the rotary. The upper flanges are provided with indexable clearance portions for allowing the axial entry and removal of the input drive gear of the power module with the idler gears.

Another object of the present invention is the provision of an interlocking engagement of the throttle of the power tong with the power tong door for preventing actuation of the throttle to an operating condition until the door is closed and also preventing opening of the door until the throttle is placed in a non-operating position. One type of suitable interlocking mechanism is the use of a slide plate connected to a crank arm on the door which coacts with the throttle. More specifically the slide bar may include a T-shaped slot in which the throttle is positioned in the head of the slot when the door is closed allowing clearance for actuation of the throttle and in which the throttle is restrained in the tail of the slot in its non-operative position.

Another object of the present invention is the provision of a tong assembly having a torque sensing module placed between the tong assembly and a back-up tong and arranged hydraulically to shift friction gear changes clutches in the power module in response to developed torque.

Another object of this invention is to provide a modular tong assembly which is structurally compact, with flexible power input requirements, and with optional drive gear characteristics.

Another object of this invention is the provision of a modular tong assembly having a power input means including a compound planetary drive gear train, with speed change accomplished by shifting the sun gear power input shaft into planet gear engagement, for speed reduction; or into keyed engagement with the planet arm for primary train by-pass.

Another object of the present invention is the provision of a modular tong assembly having a power input means including a compound planetary drive gear train, with speed change accomplished by energizing a friction lock-out clutch between the ring gear and the planet arm of the primary train for by-pass of the primary train. A stationary clutch may be energized to lock the primary ring gear in fixed position for speed reduction. Output speeds will vary in a manner proportional to the slippage permitted on clutch engagement.

Other and further objects, features, and advantages of the present invention will be apparent from the following description of the presently preferred embodiment of the invention, given for the purpose of disclosure and taken in conjunction with the accompanying drawings.

DESCRIPTION OF THE PREFERRED EMBODIMENT

FIG. 3 is a vector diagram illustrating the input force translation of force applied to a tubular member.

FIG. 4 is a vector diagram illustrating the resolution of the translated vectors into normal and tangential components.

FIG. 5 is a vector diagram illustrating the radial range of grip action of the grip elements of a tong.

FIG. 6 is a vector diagram illustrating the forces generated by a cam-loaded triangular-bar force inducing mechanism.

FIG. 7 is a vector diagram illustrating the force vectors translated by a tong according to the present invention having toggled jaws.

FIG. 8 is a vector diagram illustrating the geometry of one of the toggled jaws of FIG. 7.

FIG. 15 is a vector diagram illustrating the working diameter range of toggled jaws.

FIG. 16 is a vector diagram illustrating the limiting action of arcuate slots on toggled jaw movement.

FIG. 17 is a vector diagram illustrating toggled jaws moving within the range of arcuate slots to grip a tubular member.

FIG. 18 is a vector diagram illustrating toggled jaw coaction with a counter-reactive drag mechanism.

FIG. 19 is a plan view of a toggle link according to the present invention.

FIG. 19*a* is a front side view of the link of FIG. 19.

FIG. 20 is a front side view of a journalled solid jaw according to the present invention.

FIG. 21 is a plan view of a journalled solid jaw according to the present invention.

FIG. 22 is a plan view of an orienting lug.

FIG. 22*a* is a cross sectional view of the lug of FIG. 22.

FIG. 23 is a plan view of a toggle link for use with a beam jaw.

FIG. 23*a* is a side view of the link of FIG. 23.

FIG. 24 is a plan view of a beam-type jaw.

FIG. 24*a* is a back side view of the jaw of FIG. 24.

FIG. 25 is a plan view of another toggle link.

FIG. 25*a* is a side view of the link of FIG. 25.

FIG. 26 is a plan view of another toggle link.

FIG. 26*a* is a side view of the link of FIG. 26.

Figure 27:
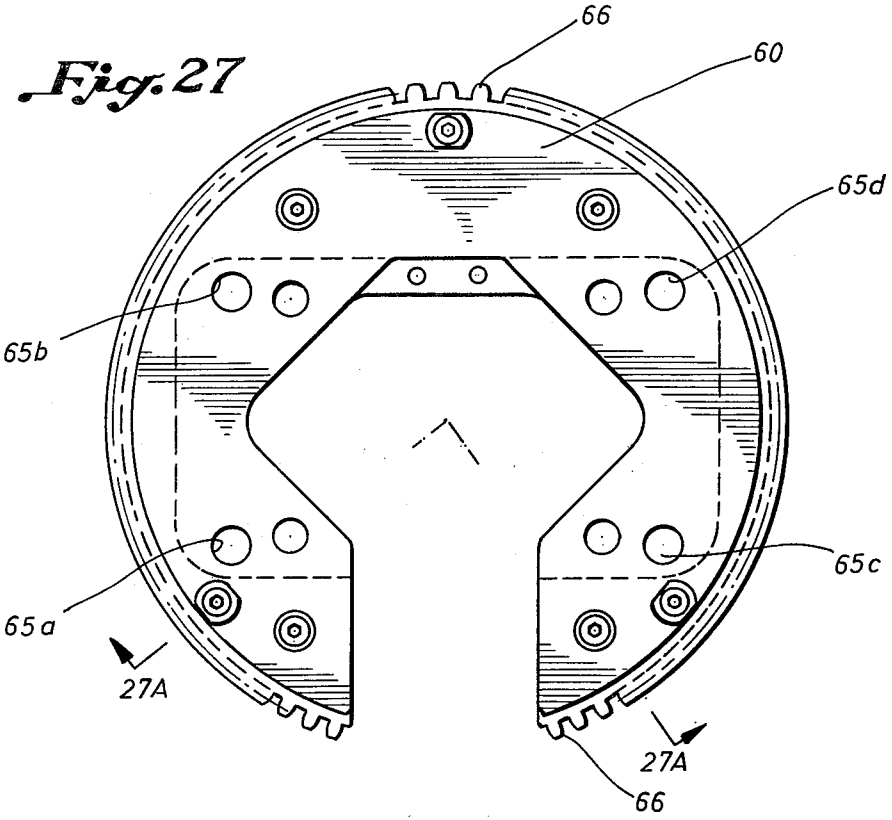

FIG. 27 is a plan view of a rotary assembly.

Figure 27A:
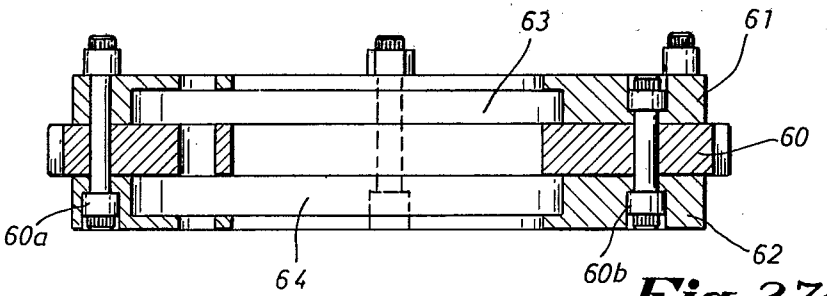
Figure 27B:
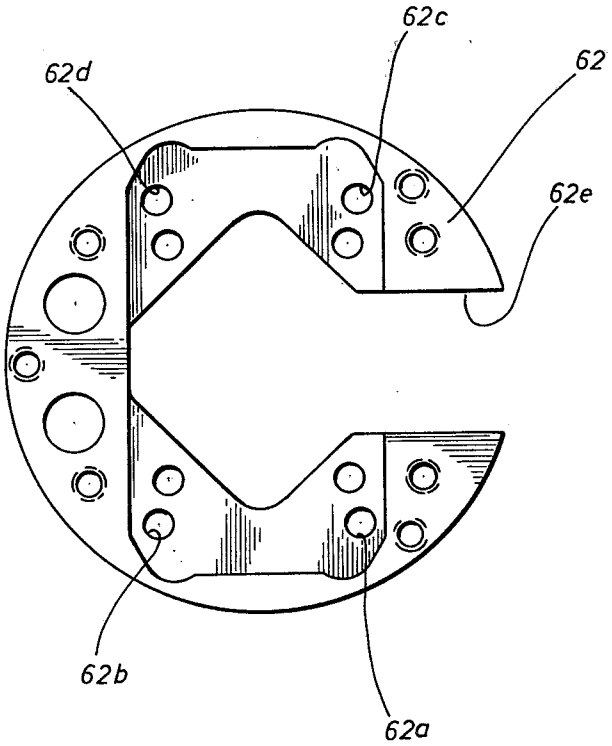
Figure 27C:
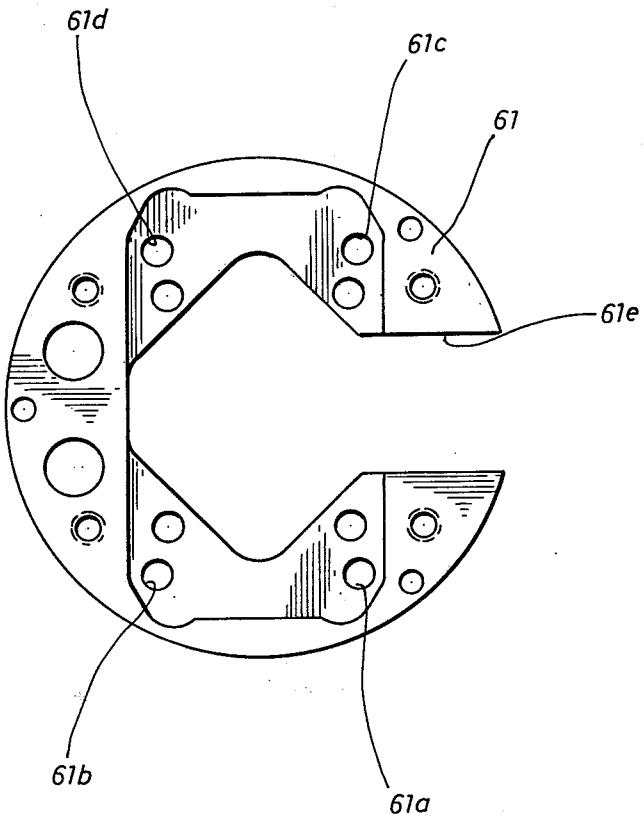

FIG. 27*a* is a side view partially in cross section of the rotary assembly of FIG. 27. FIG. 27*b* is a top view of the bottom plate of the rotary assembly of FIG. 27*a*. *FIG. 27c* is a top view of the top plate of the rotary assembly of FIG. 27*a*.

Figure 28:
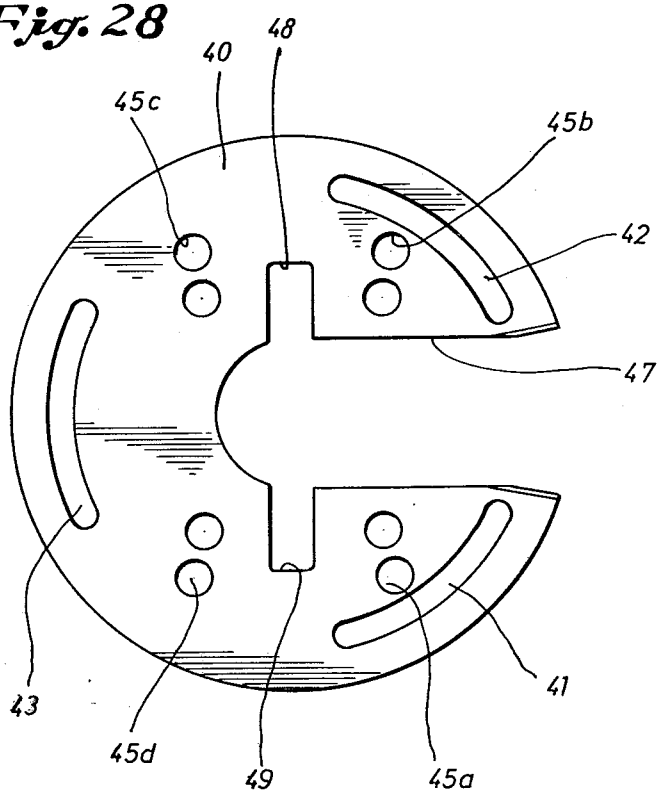

FIG. 28 is a plan view of a drag plate.

FIG. 29 is a partial plan view, partially cut away, of a toggled jaw and rotary assembly according to the present invention.

FIG. 29*a* is a cross sectional side view of one of the jaws in FIG. 29.

FIG. 30 is a schematic diagram illustrating the limitation of retractive movement of a jaw by stop means.

FIG. 31 is a schematic diagram illustrating the limitation of the grip movement of a jaw by stop means.

Figure 32:
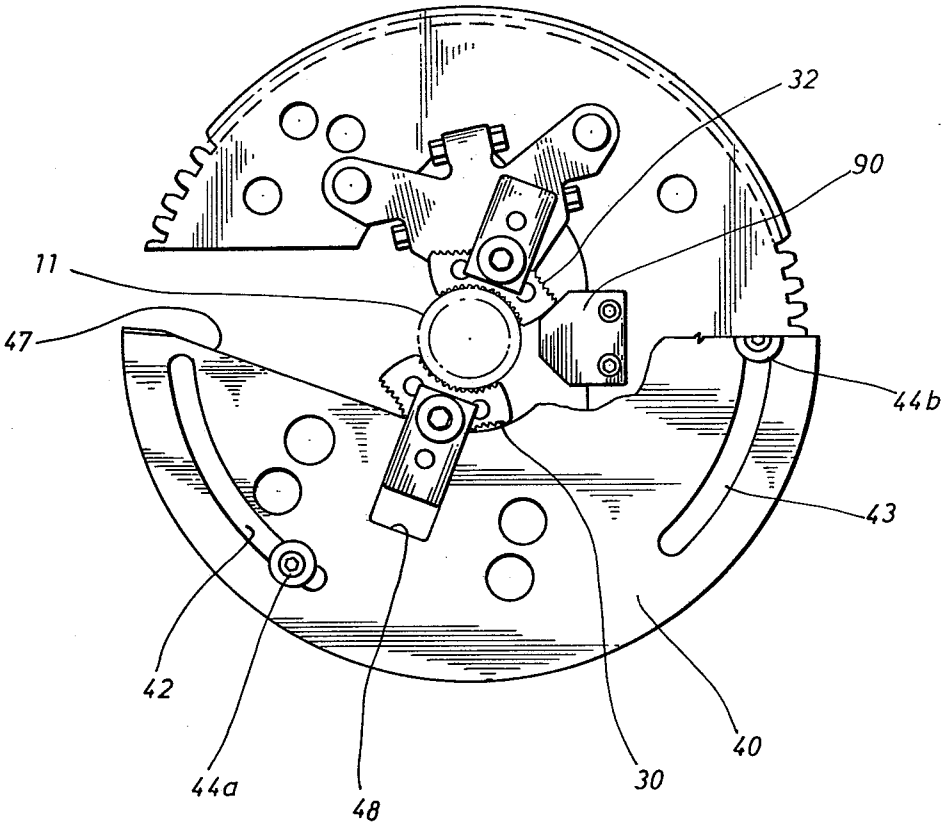

FIG. 32 is a split plan view of a tong head according to the present invention illustrating the limitation of jaw grip movement by a centering block.

Figure 33:
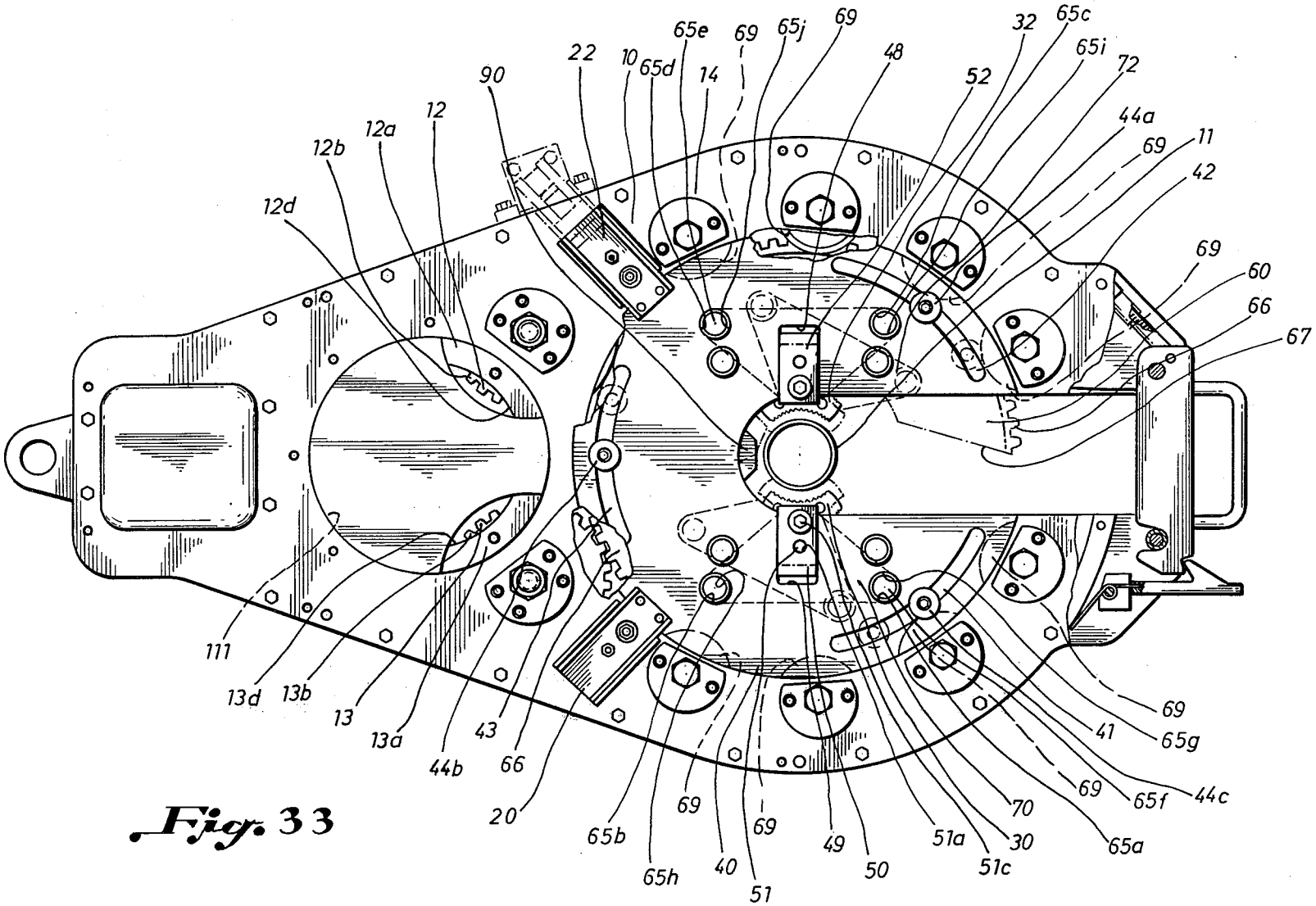

FIG. 33 is a plan view in partial cutaway of a tong assembly according to the present invention.

FIG. 34 is a cross sectional side view of a guide roller.

FIG. 34*a* is a plan view of the guide roller of FIG. 34.

FIG. 35 is a cross sectional view of an idler gear according to the present invention.

FIG. 35*a* is a plan view showing the top flange clearance indentation to allow matched axial assembly with a power module.

FIG. 36 is a cross sectional side view of a drag brake.

FIG. 36*a* is a plan view of the drag brake of FIG. 36.

Figure 37A:
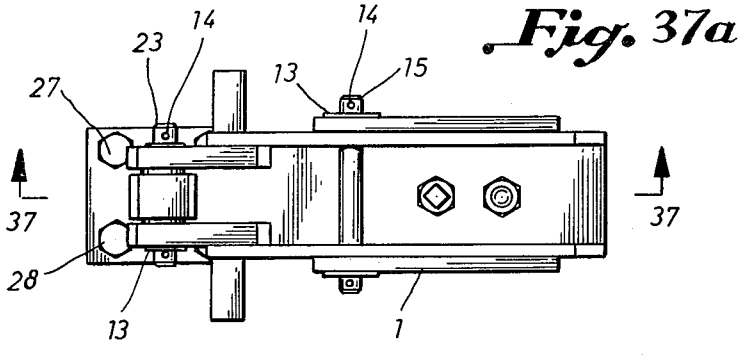
Figure 37:
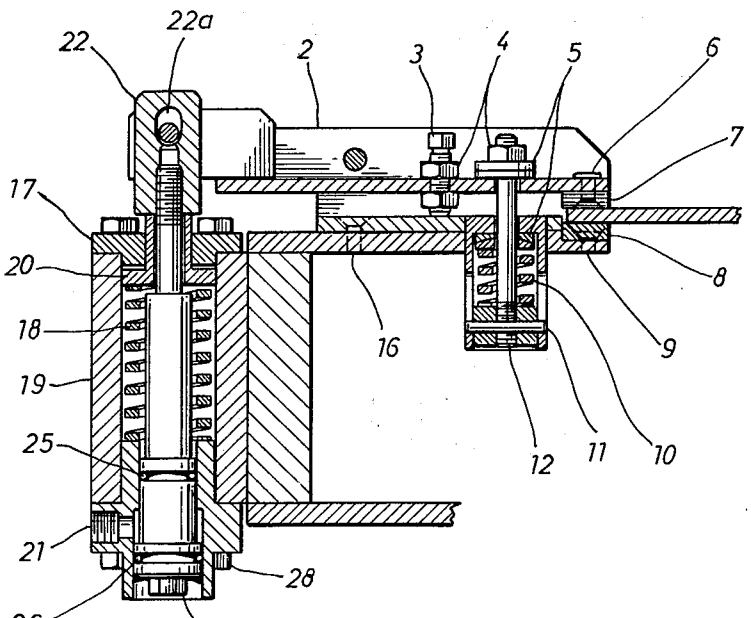

FIG. 37 is a cross sectional side view of torque responsive drag brake according to the present invention.

FIG. 37*a* is a plan view of the brake of FIG. 37.

Figure 38A:
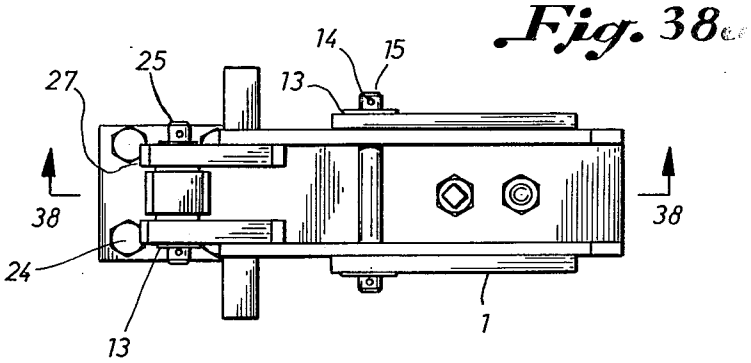
Figure 38:
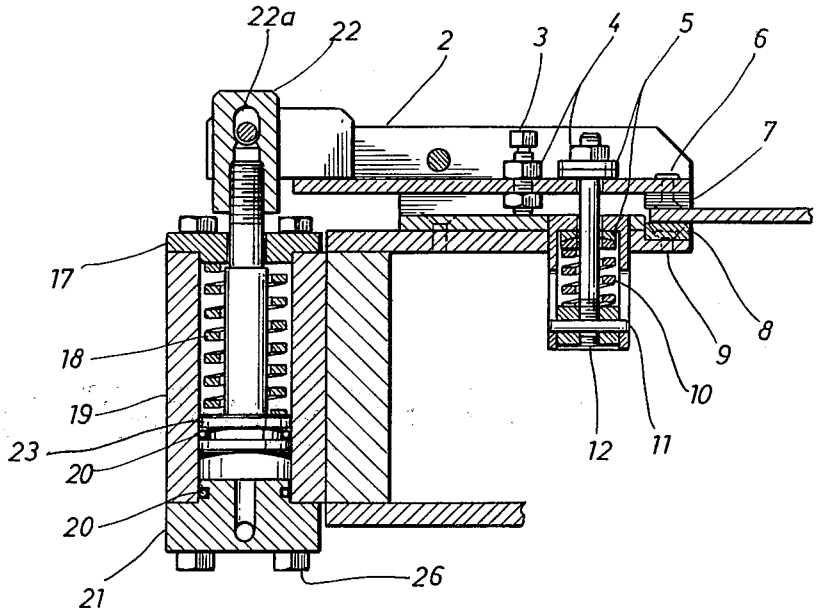

FIG. 38 is a cross sectional view of another type of torque responsive brake according to the present invention.

FIG. 38*a* is a plan view of the brake of FIG. 38.

FIG. 39 is a side view in partial cross section of a safety lockout throttle according to the present invention.

FIG. 39*a* is a plan view in partial cutaway of the throttle of FIG. 39.

FIG. 39*b* is a side rear view of the throttle of FIG. 39.

Figure 40:
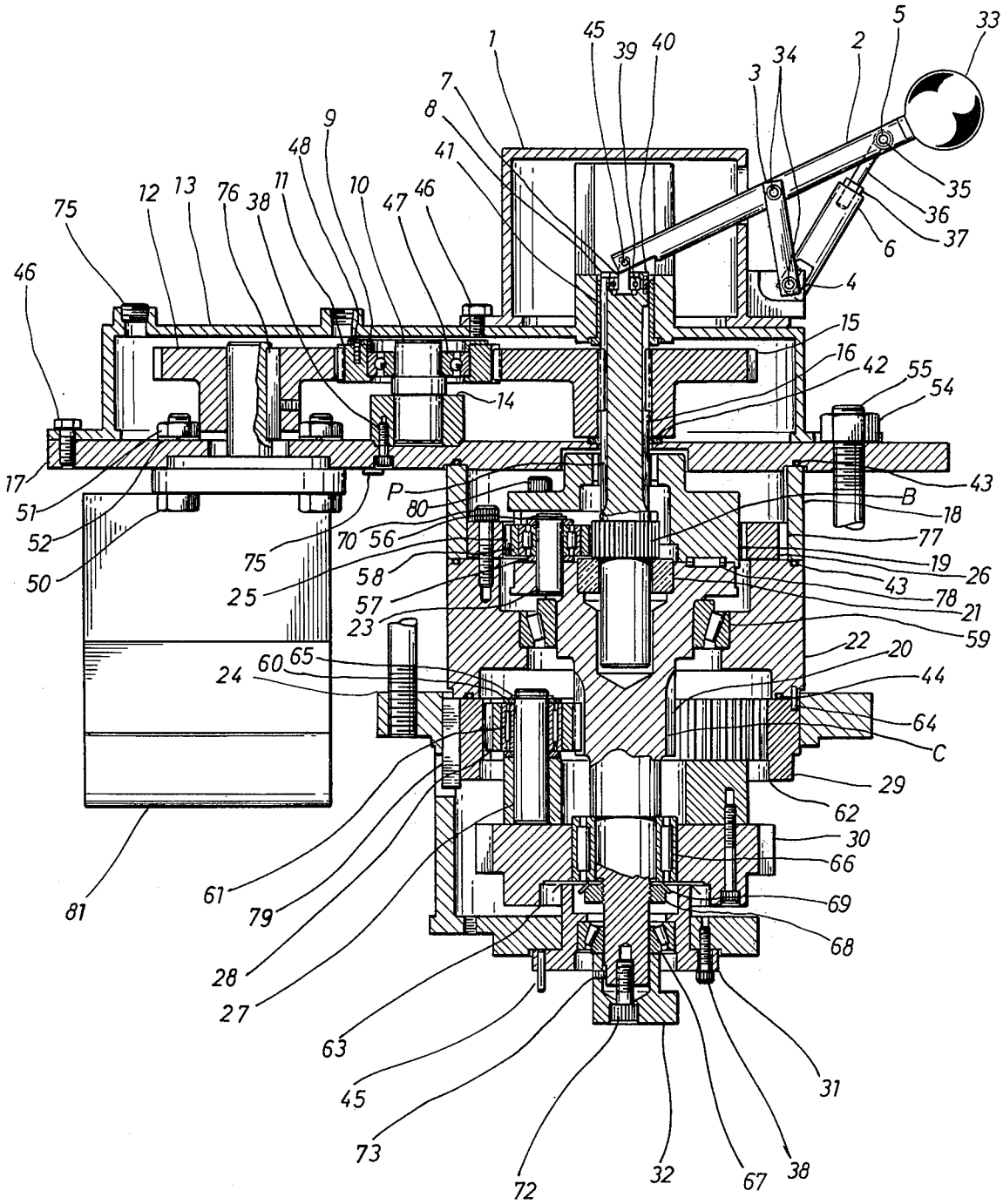

FIG. 40 is a cross sectional view of a manual shift drive gear mechanism according to the present invention.

Figure 41:
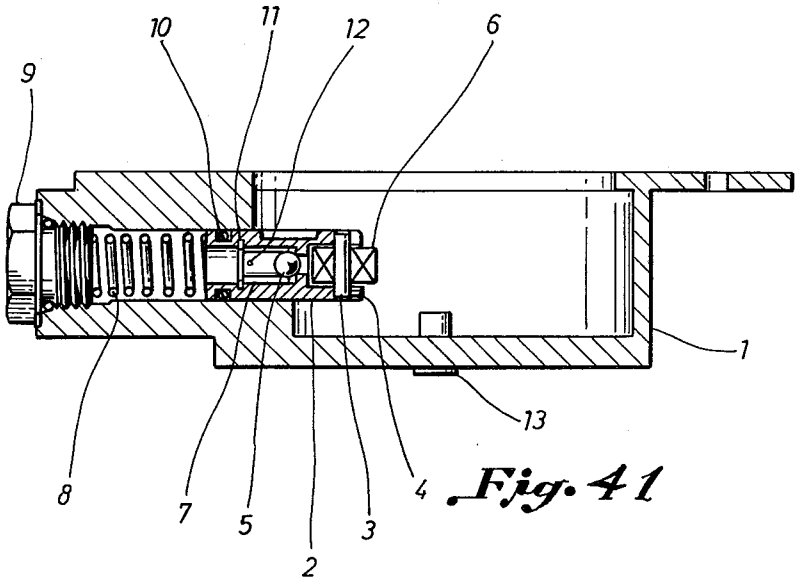

FIG. 41 is a cross sectional view of an oil circulating pump for the drive gear mechanism of FIG. 40.

Figure 42:
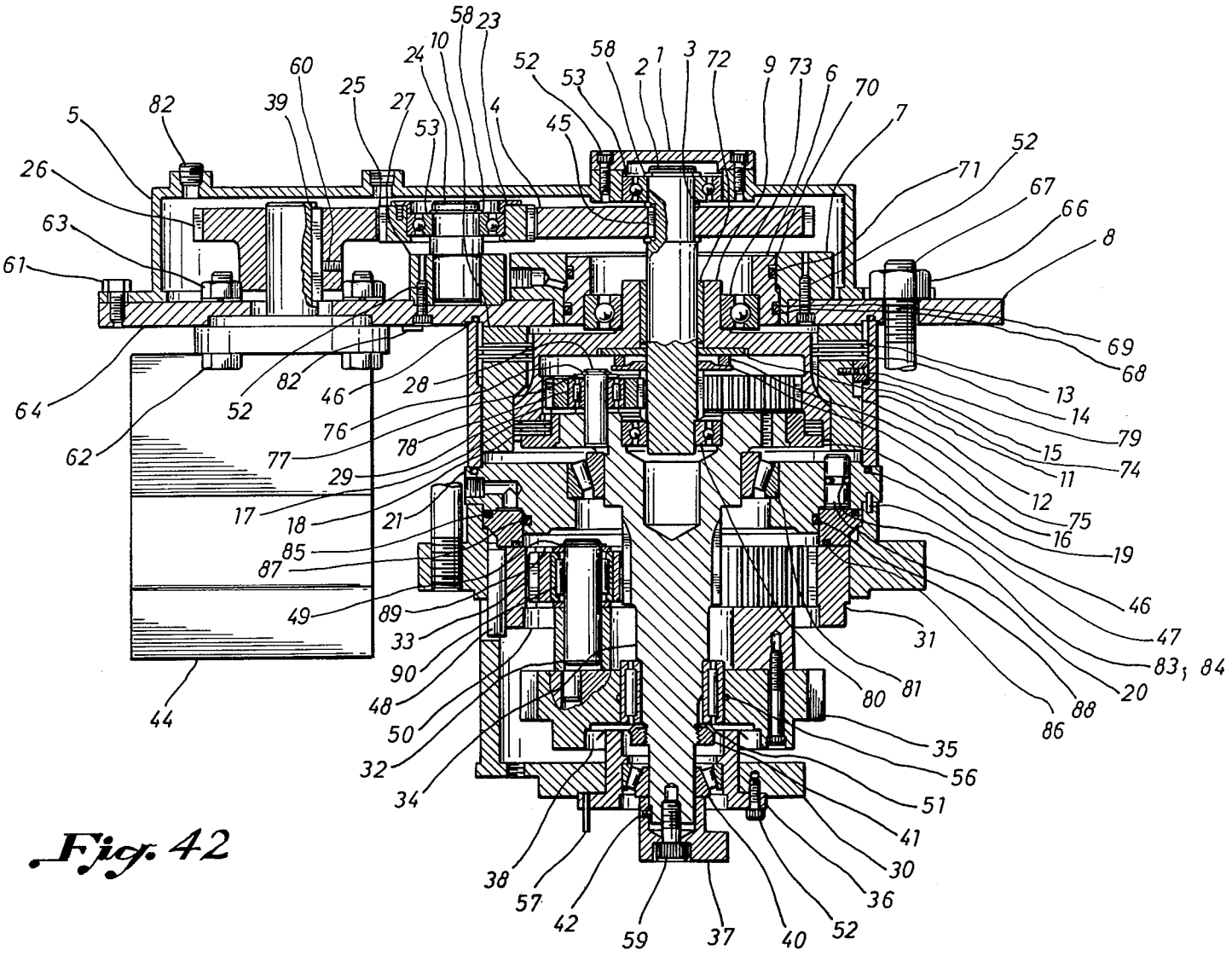
Figure 42A:
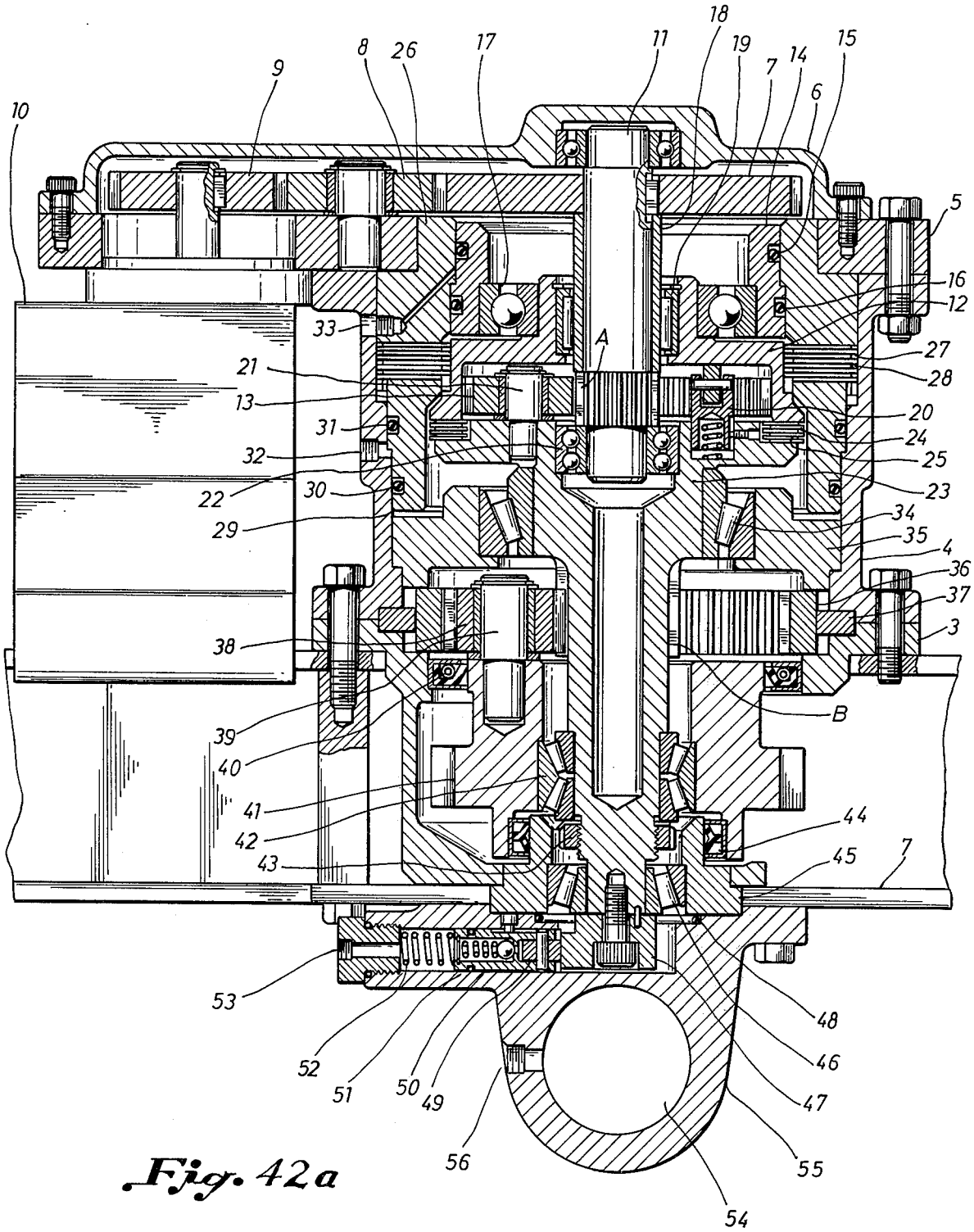

FIGS. 42 and 42*a* are cross-sectional views of a friction shift drive gear mechanism according to the present invention.

Figure 43:
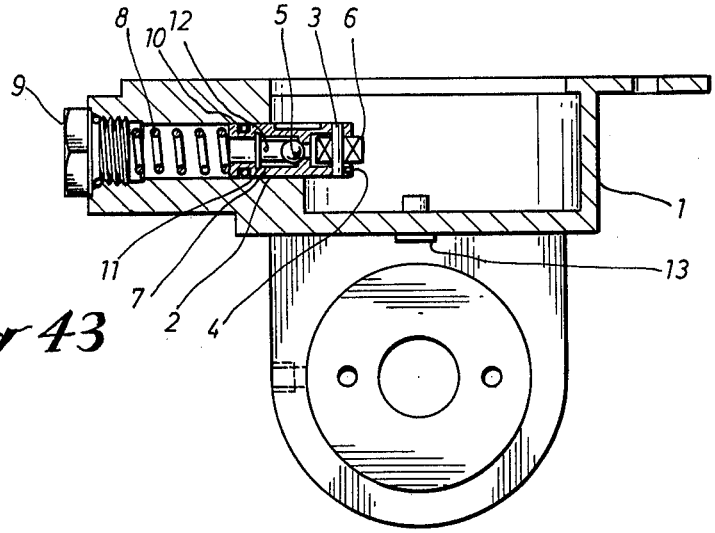

FIG. 43 is a cross sectional view of an oil circulating pump with transducer.

Figure 44:
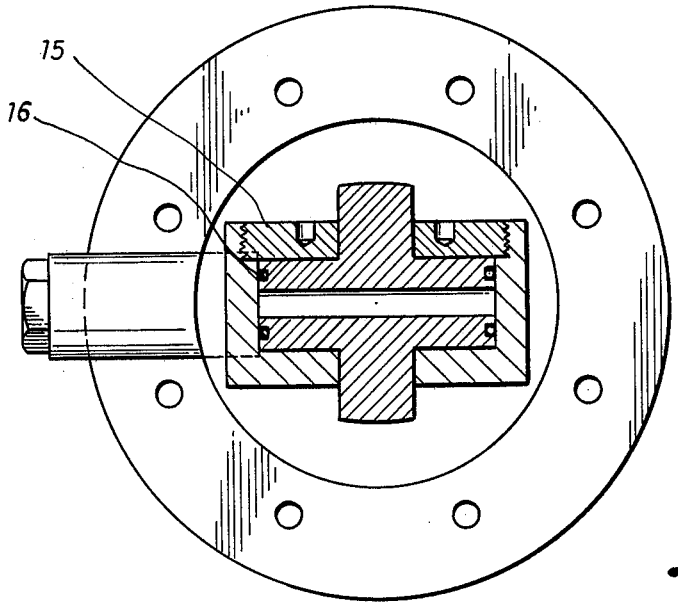

FIG. 44 is a cross sectional view of a torque transducer according to the present invention.

FIG. 45 is a plan view of a back-up tong and torque transducer connection according to the present invention.

FIG. 46 is a schematic diagram of a hydraulic circuit for automatically shifting a drive gear mechanism in response to torque change.

Figure 47A:
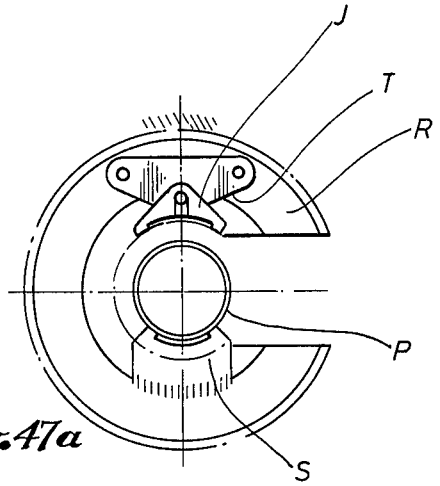
Figure 47B:
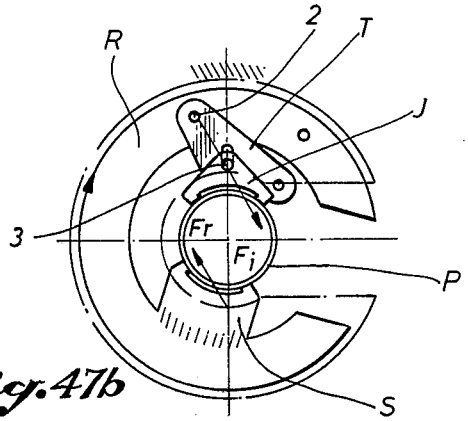
Figure 47C:
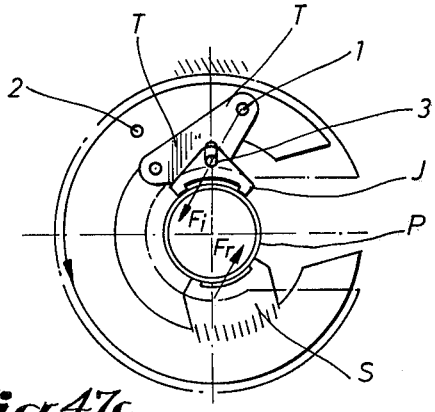

FIGS. 47*a, b,* and *c* are schematic diagrams illustrating the action of a single active toggled jaw according to the present invention. FIG. 47*a* shows the jaw retracted. FIG. 47*b* shows the jaw engaged for clockwise rotation. FIG. 47*c* shows the jaw engaged for counterclockwise rotation.

Figure 48A:
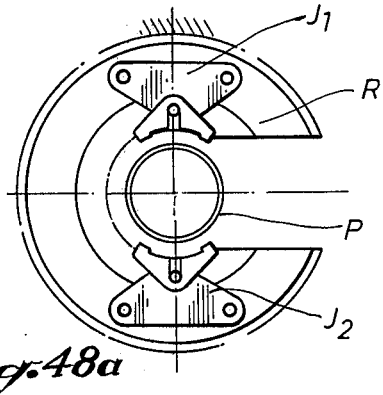
Figure 48B:
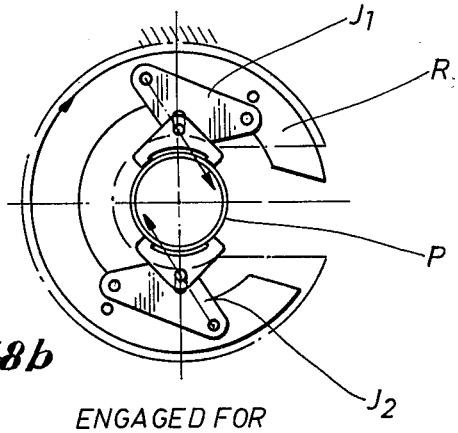
Figure 48C:
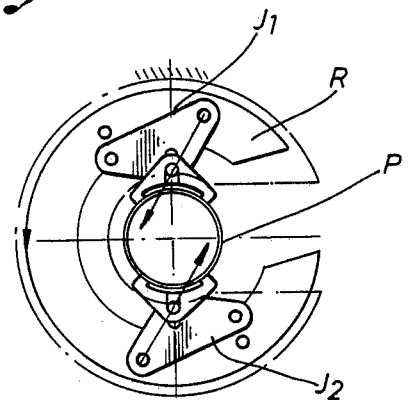

FIGS. 48*a, b,* and *c* are schematic diagrams illustrating the action of two active toggled jaws in a tong assembly according to the present invention. FIG. 48*a* shows the two jaws retracted. FIG. 48*b* shows the two jaws engaged for clockwise rotation. FIG. 48*c* shows the two jaws engaged for counterclockwise rotation.

Figure 49A:
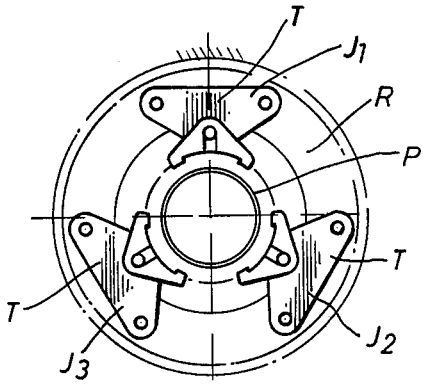
Figure 49B:
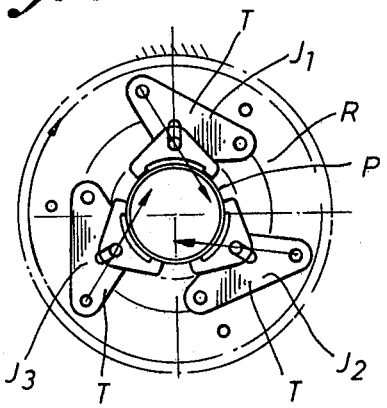
Figure 49C:
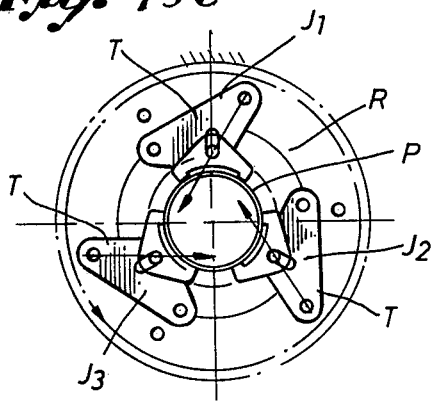

FIGS. 49*a, b,* and *c* are schematic diagrams illustrating the action of three active toggled jaws according to the present invention. FIG. 49*a* shows the jaws retracted. FIG. 49*b* shows the jaws engaged for clockwise rotation. FIG. 49*c* shows the jaws engaged for counterclockwise rotation.

Figure 50:
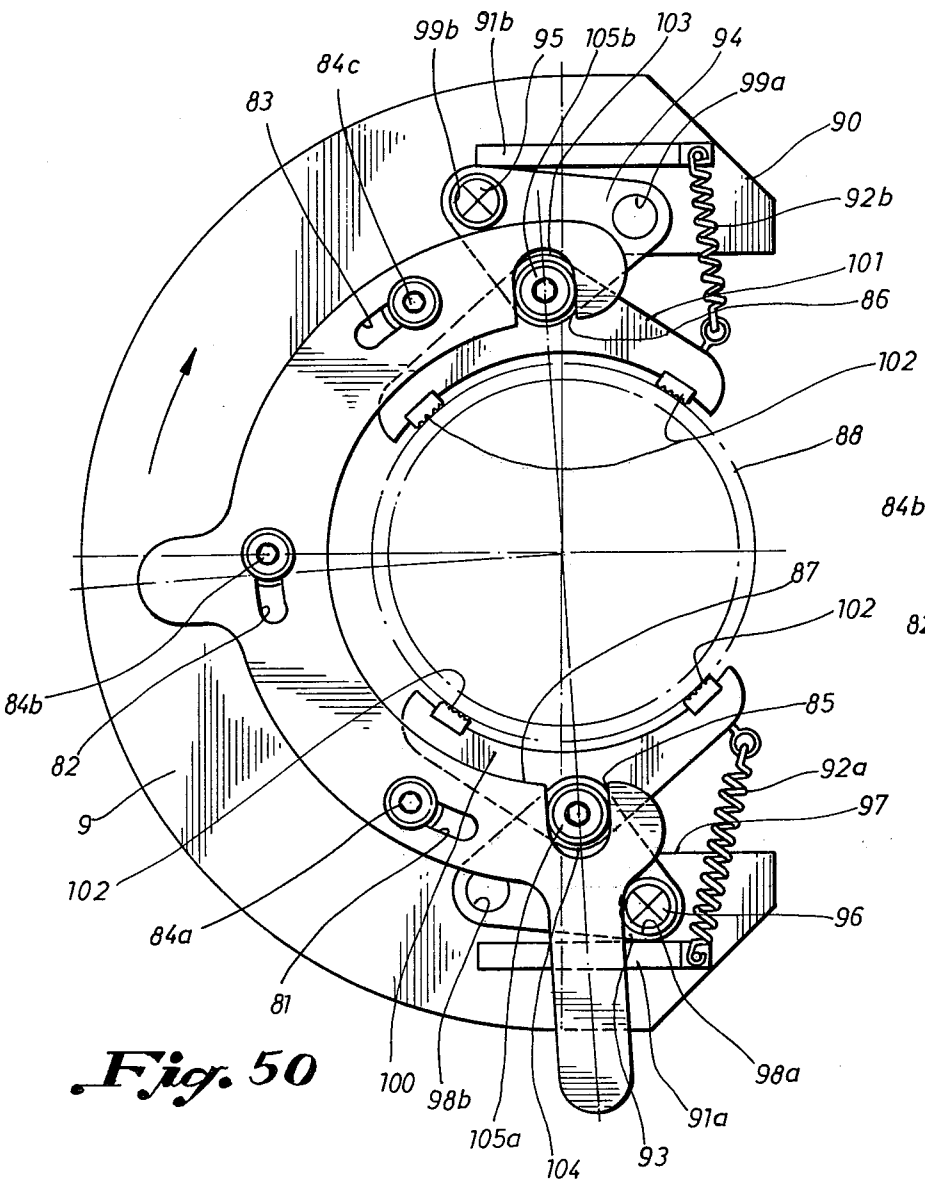

FIG. 50 is a plan view of a back-up tong according to the present invention with its toggled jaws retracted.

Figure 51:
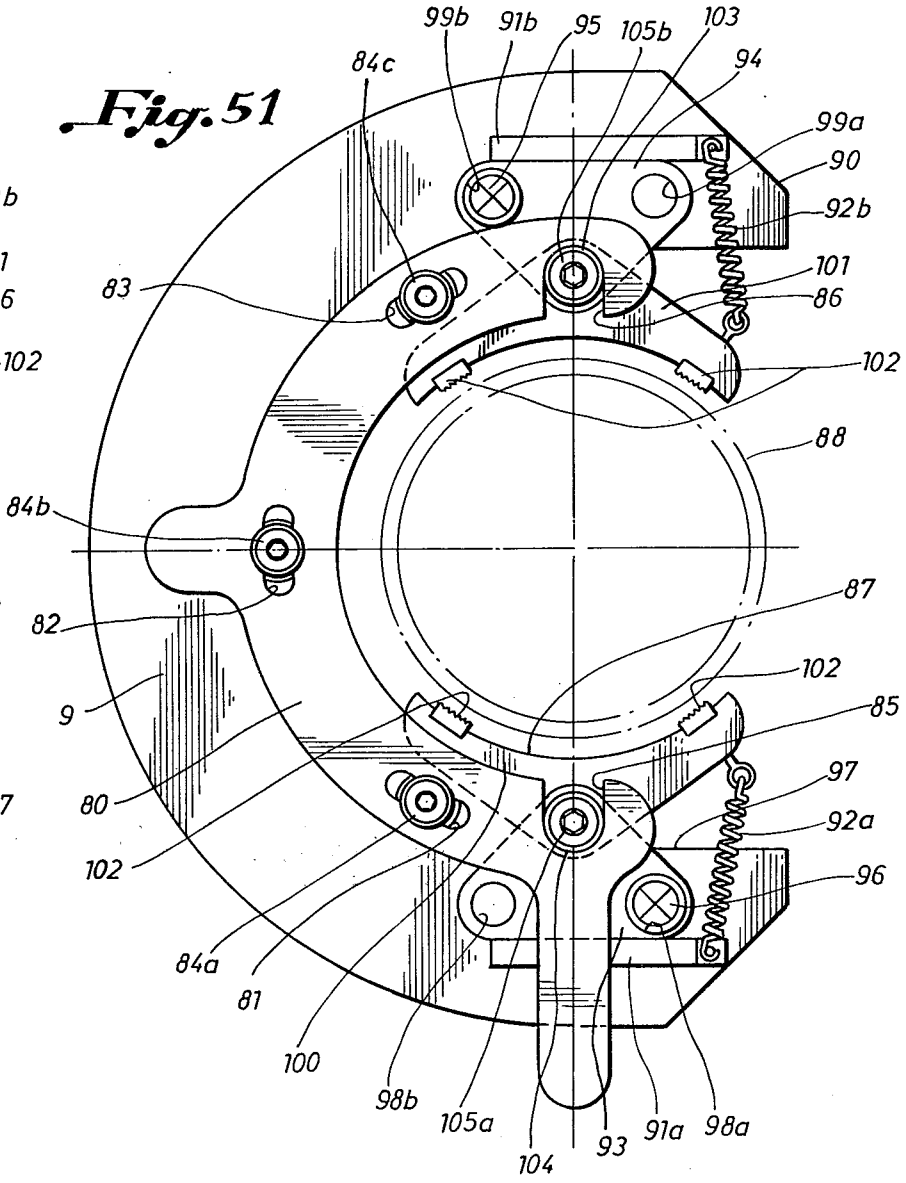

FIG. 51 is a plan view of a back-up tong according to the present invention with its toggled jaws engaged.

DESCRIPTION OF PREFERRED EMBODIMENT

Figure 1:
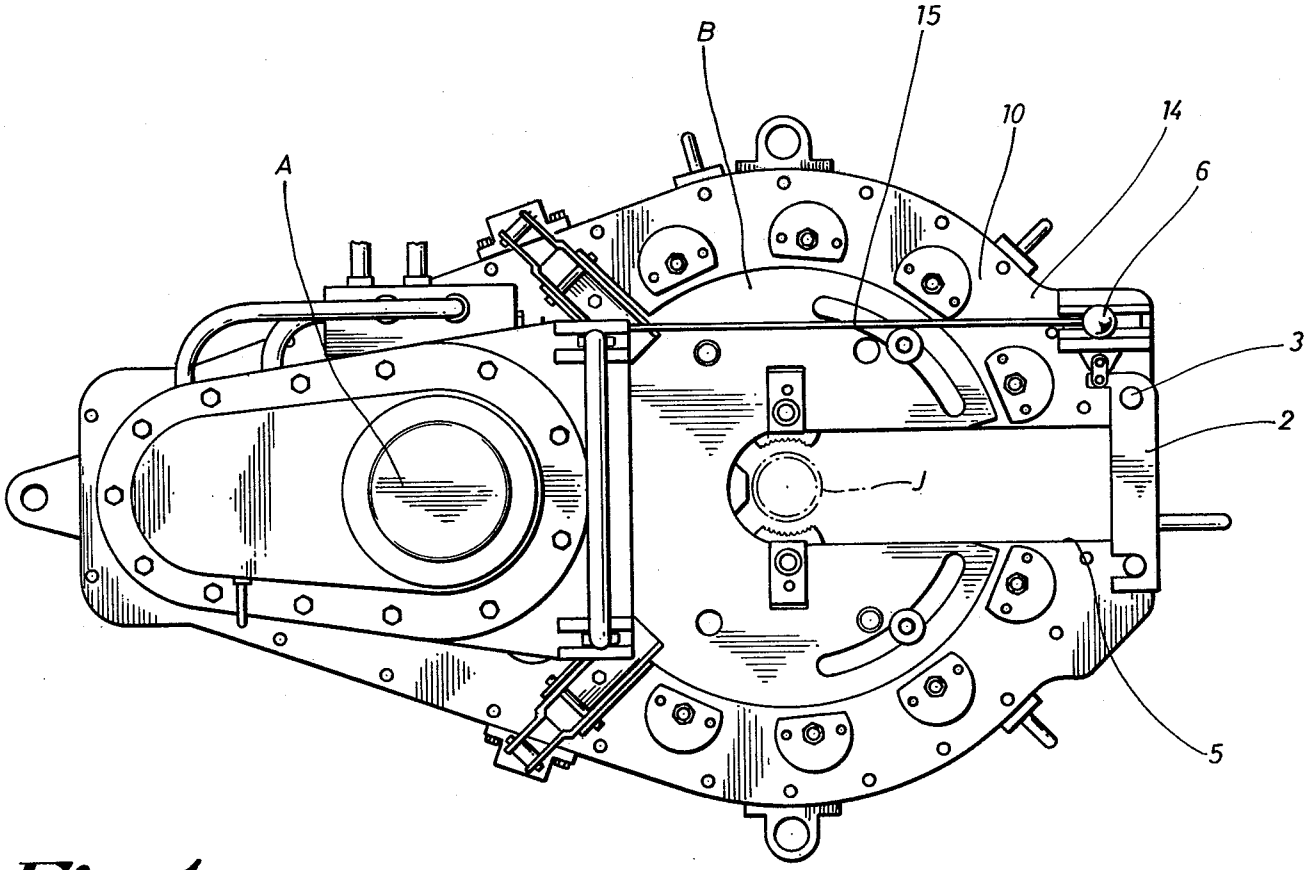
FIG. 1 is a plan view of a modular tong assembly according to the present invention.
Figure 2:
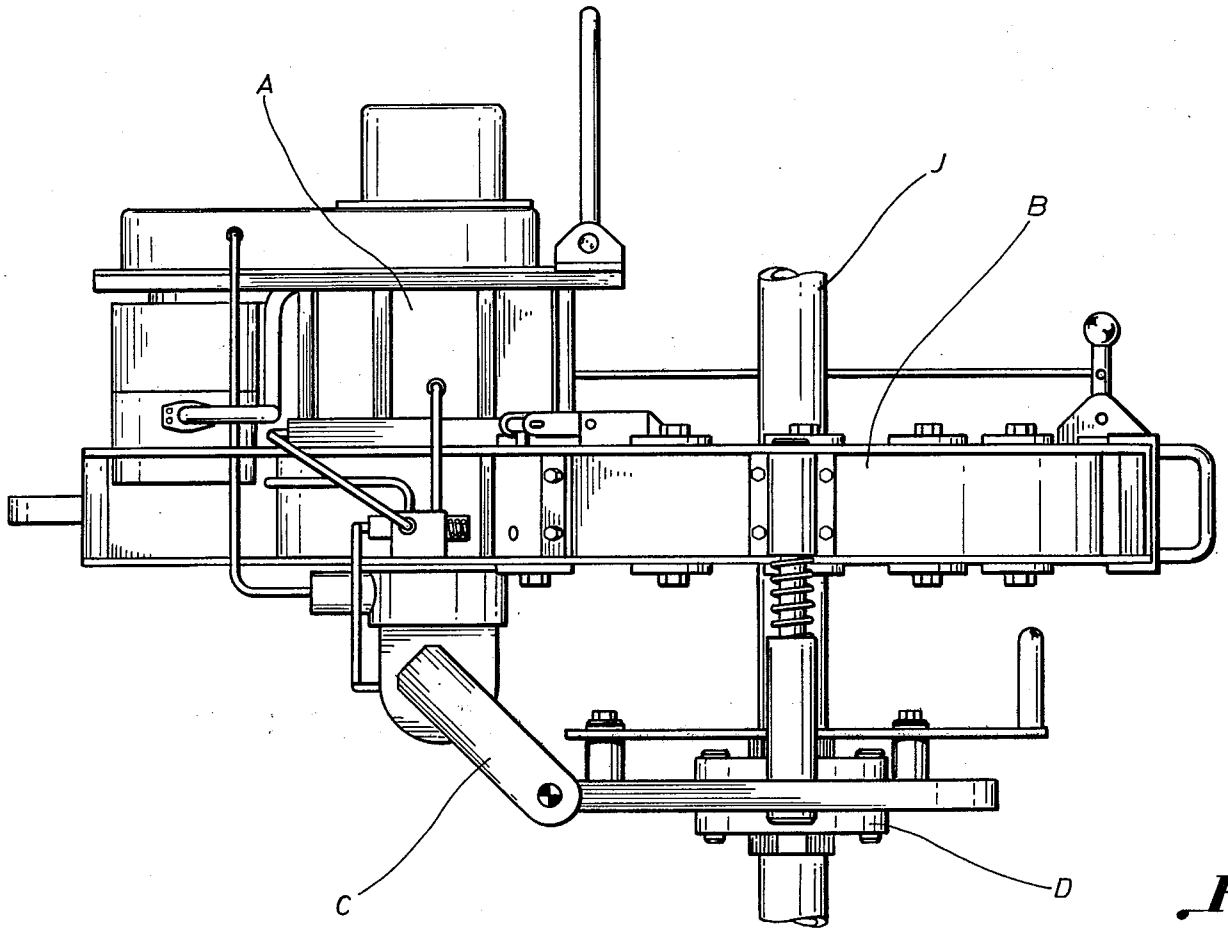
FIG. 2 is a side view of the tong assembly of FIG. 1.
Figure 9:
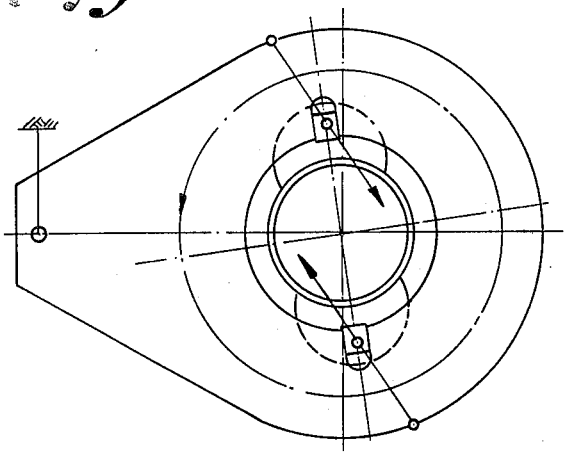
FIG. 9 is a vector diagram illustrating a back-up tong having toggled jaws according to the present invention.
Figure 10:
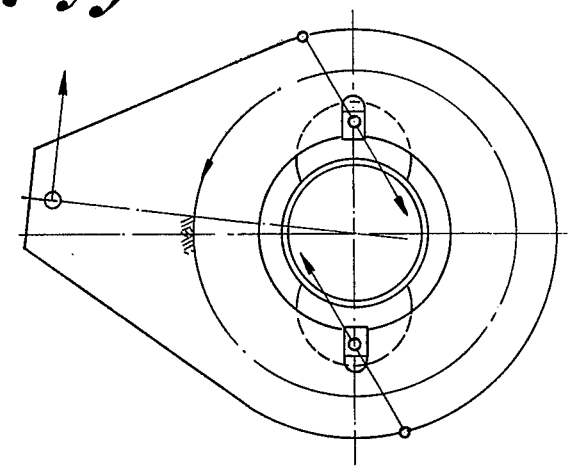
FIG. 10 is another vector diagram illustrating the back-up tong of FIG. 9.

Referring now to the drawings, FIGS. 1 and 2 illustrate a modular tong assembly according to the present invention. The modular assembly includes a power input module A and a tong head module B in position about a joint to be worked J. Torque responsive module C is connected between power input module A and backup tong module D which is in place about joint J.

Referring now to FIG. 33, tong head 10 is a tong head according to the present invention. The tong head 10 comprises a housing 14, intermediate drive gears 12 and 13, brakes 20 and 22, jaws 30 and 32, drag plate 40 with arcuate slots 41, 42 and 43, jaw orienting lugs 50 and 52, carrier or rotary element 60, toggle links 70 and 72, and guide rollers 69. For purposes of disclosure, the embodiment illustrated in FIG. 33 is a power tong as opposed to a manual tong or backup tong. Therefore, the element 60 in FIG. 33 is a rotary element whereas in a backup or manual tong there is a beam carrier element.

The drag plate 40 in FIGS. 28, 29, 32 and 33 has arcuate slots 41, 42 and 43. The drag plate 40 has recess 47 for receiving the tubular member 11 as shown in FIGS. 32 and 33. The drag plate 40 has guide slots 48 and 49 for coacting with the orienting lugs 50 and 52, respectively, which are connected to the jaws 30 and 32, respectively. Drag plate mounting posts 44*a*, 44*b* and 44*c* extend through arcuate slots 42, 43 and 41, respectively, and the drag plate 40 moves about these mounting posts in axial alignment with the rotary element 60. Recess 47 of drag plate 40 registers with recess 67 of the rotary element 60 for receiving the tubular member to be worked. Access holes 45*a*, 45*b* and 45*c* and 45*d* are provided in the drag plate 40 as shown in FIGS. 28 and 29. The access holes 45*a*, 45*b*, 45*c*, and 45*d* are axially alignable with holes 65*a*, 65*b*, 65*c* and 65*d* in the rotary element 60 when in jaw retraced condition to permit insertion or removal of the pivot pins 65*e* and 65*f* which connect the toggle links 70 and 72 at pivot points 75*a* and 75*d* or 75*d* and 75*c* as shown in FIGS. 32 and 33.

Referring now to FIGS. 27 and 27*a*, the rotary element 60 has top plate 61 and bottom plate 62 secured to it. A cavity 63 is formed between the top plate 61 and the rotary element 60 and a similar cavity 64 is formed between the bottom plate 62 and the rotary element 60.

Referring now to FIG. 33 a plurality of guide rollers 69 are mounted within the housing 14. An individual guide roller 69 is illustrated in FIGS. 34 and 34*a*. The guide rollers 69 act in conjunction with the radially extending flanges 12*a* and 13*a* on idler gears 12 and 13, respectively, to guide the rotary element 60 during its rotation. The guide rollers 69 maintain the meshed relationship between the gear teeth 66 on the circumference of the rotary element 60 and the teeth 12*b* and 13*b* on the idler gears 12 and 13, respectively. FIG. 35 shows only idler gear 12 but idler gear 13 is identical. For clockwise rotation, toggle link 70 is pivoted through hole 65*a* with pin 65*f* and link 72 is pivoted through hole 65*d* with pin 65*e*. For counterclockwise rotation pivot pin 65*f* is removed from hole 65*a* and inserted through toggle link hole 65*h* of link 70 into hole 65*b* and pivot pin 65*e* is removed from hole 65*d* and inserted through toggle link hole 65; in link 72 into hole 65*c*. Referring now to FIG. 27*c*, the top plate 61 has the recess 61*e* for receiving the tubular member to be worked and the holes 61*a*, 61*b*, 61*c*, and 61*d* corresponding to the holes 65*a*, *b*, *c*, and *d* of the rotary 60 and the holes 62*a*, *b*, *c*, and *d* of the bottom plate 62 (FIG. 27*b*) for receiving appropriate securing means such as the post 60*a* and the bolt 60*b* for securing together the top plate 61, the rotary 60, and the bottom plate 62. The bottom plate 62 has the recess 62*e* for receiving the tubular member to be worked. As shown in FIG. 29*a*, a toggle link such as toggle link 70 is comprised of two plates 70*a* and 70*b* which are assembled on the journals 30*a* and 30*b* of the jaw 30 (FIGS. 20 and 29*a*). The plates 70*a* and 70*b* of the toggle link 70 are disposed in the cavities 63 and 64 respectively of the rotary 60-top plate 61-bottom plate 62 assembly. The desired drive gear module A, FIG. 1, is insertable into opening 111, FIG. 33, to drive the idler gears 12 and 13 and, in turn, the rotary element 60. The idler gears 12 and 13 are provided with timed clearance indentations 12*d* and 13*d*, respectively, to permit proper meshing of the desired drive gear module A with the idler gears 12 and 13.

Referring now to FIGS. 20 and 21, jaw 30 (which is identical to jaw 32) has integral toothed faces 31*a*, *b*, and *c*. The toothed face 31*a* has component toothed faces 31*aa*, 31*ab* and 31*ac*. The other toothed faced 31*b* and 31*c* have similar component toothed faces. The jaw 30 has indexing holes 33*a*, 33*b* and 33*c* which can be selectively aligned as desired with hole 51*a* in the orienting lug 50 so that the dowel 51 can be inserted through the orienting lug 50 and the desired hole 33*a*, *b* or *c* so that the desired toothed face 31*a*, *b* or *c* is facing the tubular member to be worked. The orienting lug 50 is illustrated in FIG. 22. The shank 34 (FIG. 20) of the jaw 30 extends through the opening 51*b* (FIGS. 22 and 22*a*) in orienting lug 50. As shown in FIG. 20, the jaw 30 has the tapped recess 30*a* for receiving the screw 51*c* (FIG. 33) for securing the orienting lug 50 to the jaw 30. It should be understood that either the solid jaw taught by the present invention or a conventional beam-type jaw such as that disclosed in FIGS. 24 and 24*a* can be used with a tong according to the present invention. The beam-type jaw 80 shown in FIG. 24 has a plurality of arcuately replaceable toothed dies 81 for contacting the joint to be worked. As shown in FIG. 24*a*, the beam-type jaw 80 has an integral orienting lug 82 which coacts with slots 48 and 49 in drag plate 40 to maintain symmetry and alignment of the jaw face 83 with the joint contour. The toggle link 78*c* is pivotably assembled with beam type 80 by inserting pivot pin 84 through hole 85*a* in jaw 80 and through hole 85*b* in link 78*c*. The link 78*c* is composed to two plates such as the plate 78*d* shown in FIG. 23*a*.

The orienting lugs 50 and 52 (FIG. 33 and FIG. 22) or 82 (FIG. 24) coact with the recesses 48 and 49 of the drag plate 40 (FIGS. 28 and 33) to maintain the grip faces of the solid jaws or the toothed dies of the beam-type jaws in radial alignment and symmetry relative to the joint to be worked.

Referring now to FIG. 20, in the solid rocker jaw 30 according to the present invention, the journal sections 30*a* and 30*b* are provided between the toothed sections 31*aa* and 31*ab* and between 31*ab* and 31*ac*, respectively, so that the jaw pivot axis is located near the surface of the joint to be worked. This location of the jaw pivot axis near the joint surface insures an optimum range of effective action for the tong and provides balanced joint surface contact pressures.

Figure 11:
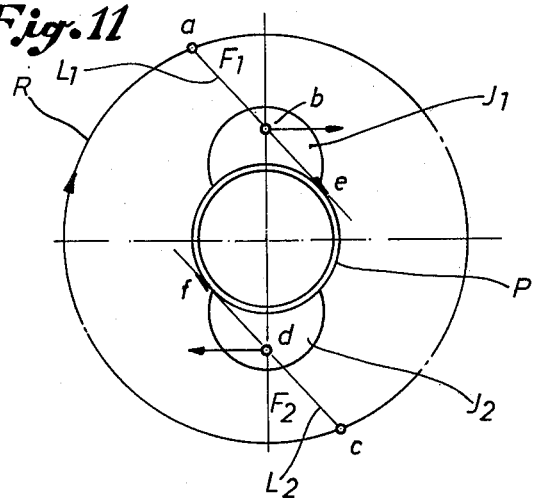
FIG. 11 is a vector diagram illustrating the angle of a force vector for a toggled jaws approaching the tangent line of the tubular member to be worked.
Figure 12:
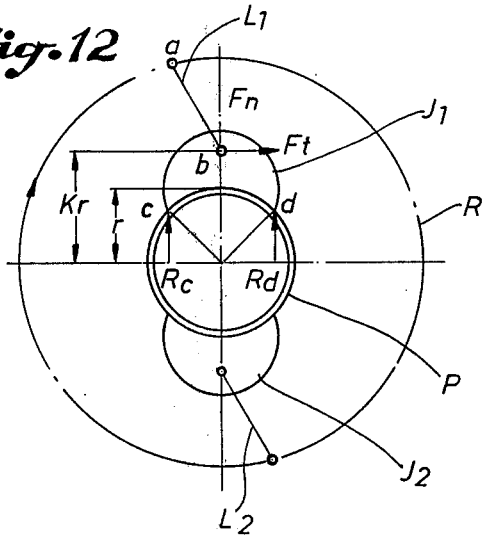
FIG. 12 is a vector diagram illustrating the reaction forces for toggled jaws.

Referring now to FIG. 11, the two toggle rocker jaws J1 and J2 will develop a force vector couple $F_1$ and $F_2$ in an unstable condition along links L1 and L2 from rotary R if the projected vector lines fall outside of the jaw-pipe P contact extremities indicated at points e and f. In FIG. 12 the resolution of fector ab is indicated. Vector ab is resolved into the normal force component $F_n$ and the tangential force component $F_t$. The pipe P contact reactions $R_c$ and $R_d$ at points c and d, respectively, may be determined and the torque delivery capability may be established as a function of the moment arms r and $K_r$ for any coefficient of drag.

Figure 13:
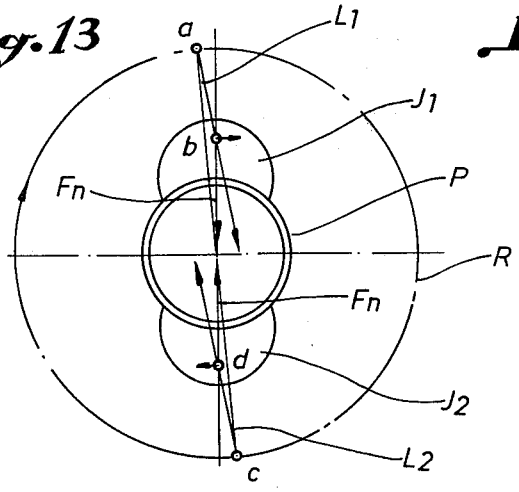
FIG. 13 is a vector diagram illustrating the angle of the force vector for a toggled jaw approaching the vertical (normal) limit.
Figure 14:
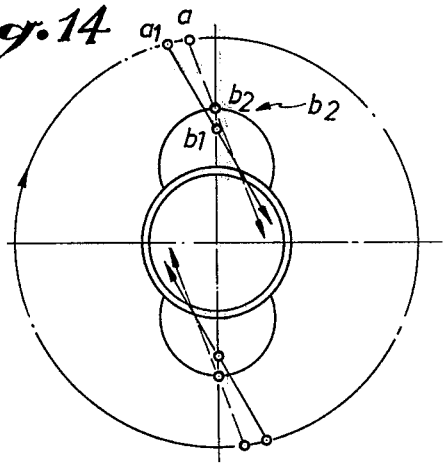
FIG. 14 is a vector diagram illustrating the effect on force range of shifting the toggled jaw pivot point inward radially.

Referring now to FIG. 13, in the toggle rocker jaw system including jaws J1 and J2, rotary R, and links L1 and L2, the input force vectors ab and cd project at an angle which renders the normal force component $F_n$ unacceptably high. In FIG. 14 is illustrated the radial difference in the pivot points $b_1$ and $b_2$ with the resultant force vectors $a_1 b_2$ and $a_2b_2$ intercepting the joint at an equivalent ratio of jaw arc span. Vector $a_1b_1$ projects along a lower slope angle than does vector $a_2b_2$ where dimension $ob_2$ is greater than $ob_1$. This invention teaches that this resultant joint diameter range capacity varies inversely with this vector slope.

Referring now to FIG. 15, jaws J1 and J2 are toggled rocker jaws according to the present invention. The rotary element is represented by R. The toggle link L is represented by the line extending from point a to point b. The joint to be worked is represented by P. The force vector of the force transmitted through the rotary R through the link L and through the jaw J1 to the joint P through the line ab cannot exceed a certain chordal limit on the joint surface P without slippage of the jaw J1 on the joint P. Also as illustrated in FIG. 15, there is a limit to the normal force which can be applied to the joint P and this is illustrated in FIG. 15 by the force vector through points a'b'. If the limit of the normal force is exceeded, damage to the pipe such as indentation and crushing will result. The force vectors through ab and a'b' are controlled according to the present invention within certain geometric design perameters to establish joint grip fidelity and to limit joint crushing force. These parameters include the radial distance from the joint center to the carrier or rotary pivot point; the toggle link length; the radial distance from the joint center to the jaw pivot point and the span of the jaw contact points on the joint. If it is assumed that dimensions ab and a'b' are equal, then, as joint size decreases, the force vector through ab will assume progressive slope increases to a predetermined limit at a'b'. Coincidentally, pivot point b will be displaced radially inwardly to limiting pivot point b'; in other words, the radial range of grip action is equal to the length from b to b' and the reactive window w for effective torque action is the angular change of slope established between force vectors through ab and a'b'. The smaller the diameter of the joint P, the smaller is the remaining acceptable reactive window w. Consequently, there is a need to minimize the radial distance from the pivot point of a jaw to the joint surface to achieve maximum effective action.

The radial range of the retractive movements of jaws according to the present invention can be controlled in a number of ways. As shown in FIG. 33, the dimensions of the recesses 48 and 49 in the drag plate 40 govern the movement of the orienting lugs 50 and 52 which in turn govern the movement inwardly and outwardly of the jaws 30 and 32. As shown in FIG. 16, the radial movement of the jaws J1 and J2 according to the present invention can be controlled by employing arcuate slots a, b, c, and d in the rotary or carrier element R with toggle links L1 and L2 pinned together at pivot point e, f, g, and h and effective to pivot selectively at the outer end of slots a, b, c, and d and to limit inward movement of alternate pivot ends as shown in FIG. 17.

Inasmuch as it is necessary to prevent the toggle link from rotating past or near radial center alignment, various means of limiting movement through structural interference between elements of the mechanism such as the centering block with jaw 32 (FIG. 32) may be employed.

Conversely, retractive jaw movement may be limited by coaction between the slots 48, 49, and the orienting lugs 50, 52 (FIG. 33); by interference of the toggle links 70, 72 (FIG. 33) with the walls of the rotary cavities 63 and 64 (FIG. 27*a*); or by employing spacer stop elements such as the spacer stop element M shown schematically in FIGS. 30 and 31. The spacer stop element M, upon movement of the toggle link L, interferes or abuts the wall W of the cavity C of the carrier-plate assembly B. The cavity C is similar to the cavities 63 and 64 shown in FIG. 27*a*.

Control of the inward or gripping movement of jaws according to the present invention may be accomplished by the use of arcuate slots a, b, c and d in the carrier or rotary element R as shown in FIGS. 16 and 17. Inward or gripping movement of the jaws may also be controlled by employing arcuate slots such as the arcuate slots 41, 42 and 43 in the drag plate 40 as shown in FIG. 33. When the slots 41, 42, and 43 are positioned with their ends abutting the posts 44*a*, 44*b*, and 44*c*, respectively, no further relative motion between the rotary 60 and the drag plate 40 can occur, consequently, radial jaw movement is inhibited. The inward or grip movement of the jaws may also be controlled by the interference of the toggle links such as the toggle links 70 and 72 in FIG. 33 with the walls of the cavities 63 and 64 of the rotary element 60 as shown in FIG. 27*a*, FIG. 30 and FIG. 31.

Referring now to FIGS. 19 and 19*a*, the generally triangularly shaped toggle link 77 has two segments, 77*a* and 77*b*. The section 77*a* has the recess 77*c* which forms when coacting with the recess 77*d* of the segment 77*b*, a recess for receiving and holding the shank, lug or journal section of a jaw, such as the journal sections 30*a* and 30*b* of the jaw 30 in FIG. 20, so that the jaw is pivotable while being held by the toggle link 77. The segment 77*a* and 77*b* are held together by appropriate means such as the bolt 77*e* and 77*f* which extend through the segments. The toggle link 77 is provided with a plurality of holes such as the hole 77*g* and 77*h* to facilitate changes in mode of operation of the tong assembly from make up mode to break out mode.

Although the toggle links 70 and 72 of FIG. 33 and the link 77 in FIG. 19 are of a generally triangular shape, other appropriate toggle means are within the scope of the present invention. For example, the toggle links 78*a*, 78*b*, and 78*c* as illustrated in FIGS. 25, 25*a*, 26, 26*a* and 23*a* respectively, can be employed to provide the desired toggling action of the jaws to which they are connected. The toggle link 78*b* as shown in FIG. 26 has two holes 78*f*, one of which provides for the pivotal mounting of the toggle link to a carrier or rotary element, the other of which provides for the pivotal mounting of the toggle link to a beam jaw (FIG. 24). The toggle links 78*a* has one hole 78*f* for pivotally mounting the toggle link to the rotary or carrier element. The toggle link 78*a* also has the recess 78*g* which is open ended and which can be employed with a jaw whose pivot center is close to the surface of the joint to be worked. The toggle link 78*c* in FIG. 23 of generally triangular shape has a plurality of holes, 85*c* and 85*d*, to facilitate changes in pivot point, and a jaw pivot hole 85*b* for connection with a beam type jaw such as the jaw 80 in FIG. 24.

Referring now to FIG. 51, the pipe 88 has been received into the recess 97 of the carrier 90 of the backup tong 9 and into the recess 87 of the drag plate 80. The rocker jaws 100 and 101 are in a retracted position in which they are not yet in contact with the surface of the pipe 88. The drag plate 80 is mounted about the drag plate mounting post 84*a*, 84*b* and 84*c* and, because of the provision of the arcuate slots 81, 82 and 83 in the drag plate 80, the drag plate 80 is movable about the drag plate mounting post 84*a*, 84*b* and 84*c* within the limits defined by the dimensions of the arcuate slots.

The toggle links 93 and 94 (FIGS. 50 and 51) are pivotally pinioned to the carrier 90. By means of the hole 98*a* and the toggle link pinion 96, the toggle link 93 is pivotally pinioned to the carrier 90 in such a way that the stop bar 91*a* connected to the carrier 90 limits the movement of the toggle link 93. Similarly, by means of the hole 99*b* and the toggle link 94 and the toggle link pinion 95, the toggle link 94 is pivotally pinioned to the carrier 90 in such a way that the movement of the toggle link 94 is limited by the stop bar 91*b* of the carrier 90. The spring 92*a* extends between the carrier at 91*a* and the rocker jaw 100 and the spring 92*b* extends between the carrier at 91*b* and the rocker jaw 101. Due to the action of the springs 92*a* and 92*b*, the jaws 100 and 101 are rocked into position to receive the joint to be worked.

The rocker jaw 100 has the die gripping elements 102 spaced evenly about its surface for engaging the surface of the pipe 88. The die gripping elements 102 are also evenly spaced about the surface of the rocker jaw 101 for gripping the surface of the pipe 88. The rocker jaw 100 has the pivot head 104 extending from it. The pivot head 104 extends into the recess 85 of the drag plate 80. The pivot head 103 of the rocker jaw 101 extends from the rocker jaw 101 into the recess 86 of the drag plate 80. During engagement as illustrated in FIG. 51, the drag mechanism causes the rocker jaws 100 and 101 to move radially into gripping contact with the surface of the pipe 88 when a counter rotation is applied between the drag plate 80 and the carrier 90. The response to this counter rotation between the drag plate 80 and the carrier 90, the toggle links 93 and 94 swing away from their respective stop bars 91*a* and 91*b*, and the rocker jaws 100 and 101 are brought into diametrically opposed balanced contact with the pipe 88. The rocker jaws 100 and 101 pivot on the end of their respective toggle links 93 and 94. The action of the drag plate 80 swings the toggle links 93 and 94 toward or away from the center of the pipe 88 while maintaining the symmetry of the rocker jaws 100 and 101 relative to the pipe 88.

The embodiment of the tong disclosed in FIG. 33 operates in a similar manner. The orienting lugs 50 and 52 of the rocker jaws 30 and 32, respectively, coact with the guide slots 48 and 49 of the drag plate 40 in a similar manner. The drag plate 40 effects the diametrical balanced alignment of multiple jaws in a multi-jaw assembly such as the jaws 30 and 32 as the jaws 30 and 32 swing toward the center of the pipe 11 when the rotary element 60 moves in a clockwise direction. Thus the jaw faces 30*a* and 32*a* are maintained in diametrical, symmetrical alignment.

Referring to FIG. 33, the input force imparted by the rotary 60 of the tong 10 is applied to the points at which the toggle link 70 and 72 are pivoted, from there through the pivot points of the rocker jaws 30 and 32, and then through the arc subtended by the span of the rocker jaws 30 and 32 to the surface of the pipe 11. In a similar manner, force is applied to the pipe 88 in FIG. 50. The symmetry and aspect of the jaw systems are maintained by the drag plate 40. Referring now to FIGS. 50 and 51, for counterclockwise movement of the carrier 90, the toggle link pinion 96 would be removed from the hole 98*a* and placed through the hole 98*b* and through a corresponding hole (not shown) in the carrier 90. Similarly, the toggle link pinion 95 would be removed from the hole 99*b* and inserted through the hole 99*a* and through a hole (not shown) in the carrier member 90. The provision of a plurality of pinion holes such as the plurality of holes illustrated for the toggle links 93 and 94 in FIG. 50 and the plurality of holes of the toggle link 77 in FIG. 19 makes possible the quick and efficient change which is necessary when going from makeup mode to breakout mode.

The toggling action for a tong employing a single rocker jaw is illustrated schematically in FIGS. 47*a*, 47*b* and 47*c*. As shown in FIG. 47*a*, the rocker jaw J is pivotally connected to the toggle link T which is in turn pivotally connected to the carrier or rotary R. The jaw J is retracted in FIG. 47*a*. In FIG. 47*b*, the rotary R has turned clockwise moving the toggle link T which in turn moves the jaw J into contact with the surface of the pipe P. For the clockwise rotation of the rotary R, the toggle link is pivoted at the point 2. As shown in FIG. 47*c*, for counterclockwise rotation of the rotary R, the toggle link T is pivoted at the point 1.

As shown in FIGS. 47*b* and 47*c*, the input force $F_i$ is transferred from the rotary R through the point at which the toggle link T is pivoted on the rotary R, through the point 3 of the rocker jaw J on the toggle link T, and then through the arc of the rocker jaw J to the surface of the pipe P. The input force $F_i$ is reacted by the reaction force $F_R$ of the fixed jaw S.

It is to be understood that the present invention is directed to a tong having one or more toggle rocker jaws. FIGS. 48*a*, *b* and *c* and FIGS. 49*a*, *b* and *c* are schematic representations of tongs having more than one rocker jaw. Each of the rocker jaws J1, J2, J3, is pivotally connected to a toggle link T which is in turn pivotally connected to a rotary or carrier element R. The jaws J1, J2 and J3 are toggled into contact with the surface of the pipe P in a manner similar to that already described for the action of the jaw J in FIGS. 47*a*, *b* and *c*.

DRAG BRAKE

Referring now to FIG. 33, drag brakes 20 and 22 are provided for retarding the rotation of the drag plate 40 relative to the rotary 60 to create the toggle action placing the jaws 30 and 32 into either a gripping engagement with the pipe 11 or a retracted position. Referring now to FIG. 37, each brake includes a housing 1 attached to case cover 14. The base 1 supports a wear plate 8 on which the drag plate 40 moves. A brake clapper beam 2 is pivotally supported from the base 1 by hinge pin 14, a friction shoe 7 is attached to the clapper beam 2 and is adapted to engage the top of the drag plate 40 to apply brake pressure to the drag plate 40. For increasing the drag pressure of the brake, the clapper beam 2 is loaded downwardly against the drag plate 40 by spring 10, one end of which acts against the housing 1 and the second end of which acts to move a rod 12 which is secured to the clapper beam 2 downwardly forcing the friction shoe 7 into a tighter engagement with the drag plate 40. Adjustment of the nut 4 permits spring adjustment of the force of the drag plate 40. A set screw 3 and locking nut 4 limits the downward travel of the friction shoe 7 relative to the drag plate 40 to insure that the friction shoe 40 does not drop into the slot 47 (FIG. 33) in the drag plate 40 as the slot 47 rotates past the brakes 20 and 22.

While the drag brake described above satisfactorily applies a drag to the drag brake 40 for actuating the jaws into a gripping or retracting position, the brakes undesirably continue to engage and create a drag on the plate 40 after they have performed their actuating function. This is undesirable as continued engagement of the brake with the plate 40 creates wear and consumes energy which could be used to provide output torque to the unit. Therefore, tong efficiency may be improved by releasing the drag brakes 20 and 22 when the jaws of the tongs are in a seated and gripped position on the pipe 11. Preferably, the brakes 20 and 22 may be released and in response to the hydraulic pressure of the motor of the power module (not shown). As shown in FIG. 37, the brakes may be released as the upstream pressure increases as torque builds up, or the brakes may be released in accordance with the embodiment of FIG. 38 when the downstream pressure decreases when torque loading occurs.

Referring now to FIG. 37, the clapper beam 2 includes a pin 23 which extends through a clevice 22 having an elongate slot 22*a*. The clevice 22 is attached to a piston 24 positioned in a cylinder 19. In order to permit full braking action, a spring 18 acts against a shoulder 20 and against the clevice 22 to urge the clevice 22 upwardly whereby the elongated slot 22 is positioned with clearance above the clapper beam 1023 as shown in FIG. 37. A fluid port 21 is positioned between differential piston area between the seals 25 and 26. An upstream pressure from the motor (not shown) increases as torque builds up, the increase in fluid pressure applied to port 21 moves the piston 24 downwardly overcoming the spring 11, closing the clearance in the slot 22*a* whereby the clevice 22 engages the pin 23 and rotates the clapper beam 2 about the pin 14 carrying the friction shoe 7 out of contact with the drag plate 40 thereby releasing the brakes 20 and 22.

Referring now to FIG. 38, another embodiment is illustrated in which like figures refer to like parts shown in FIG. 37 with the addition of the suffix "a". The clapper beam 2*a* includes a pin 23*a* which is connected in an elongated slot 17*a*. The clevis 22*a* is connected to a piston 24*a* positioned in a cylinder 19*a*. The bottom of the piston 24*a* is exposed to fluid pressure entering the port 21*a* and is connected to the downstream pressure from the motor and initially is high pressure forcing the piston 24*a* upwardly. In this condition, the elongated slot 17*a* in the clevice 22*a* is positioned with top side clearance above the pin 23*a* to permit normal full braking action on the drag plate 40. A spring 18 is positioned in the cylinder 19*a* and acts against the piston 24*a* urging the piston 24*a* downwardly. When the downstream pressure decreases as torque loading occurs, the fluid pressure entering the port 21*a* decreases the spring 18*a* to move the piston 24*a* downwardly whereby the top of the elongated slot 17*a* and the clevice 22*a* engages the pin 23*a* rotating the clapper beam 2*a* about its pivot pin 14*a* moving the friction pad 7*a* out of engagement with the rotary plate 40.

IDLER GEARS

Referring to FIGS. 33 and 35, idler gears 12 and 13 are positioned in the tong in engagement with the rotary 60 for driving the rotary 60. In turn, the idler gears 12 and 13 are adapted to receive the output drive from a power module. In addition to providing the drive to the rotary 60, the idler gears 12 and 13 include a top flange 12*a* and 13*a* and lower flanges 12*e* and 13*e* (not shown) which coact with the rotary 60 to provide a guiding support for the rotary at a location on the tong 10 where rotary guides are not provided, that is, generally opposite to the slot of the tong. Therefore, the guiding flanges 12*a*, 13*a*, 12*e*, and 13*e* also control the mesh engagement of the idler gears with the gears on the rotary element 60. However, in order to allow the insertion and removal of a power module with a driving pinion into the tong 10, the upper flanges 12*a* and 13*a* are provided with clearance sections 12*d* and 13*d* in their circumference. That is, when the clearance sections 12*d* and 13*d* are located to simultaneously register in a center alignment between the idler gears 12 and 13 and the center position for a power train input pinion, the clearance sections 12*d* and 13*d* permit axial engagement of the input pinion and the idler gears 12 and 13. The idler gears 12 and 13 are placed in the receiving or disengagement orientation position by use of a sight hole 10*a* in the case 10 which is positioned for observing of a flange 13*a* on one of the idler flanges such as 12*a* when the idler gears 12 and 13 are in the proper orientation.

While providing the clearance sections 12*d* and 13*d* in the upper flanges will reduce the area of those flanges for providing guides to the rotary 60, it is to be noted that the clearance sections 12*d* and 13*d* will never be in engagement at the same time with the rotary 60.

SAFETY THROTTLE LOCKOUT

Referring now to FIG. 1, the tong head 10 of the present invention includes a throttle knob 6 which is connected to a throttle rod 15 which is connected in turn to the power module A for applying forward or reverse power, as well as having a neutral position, for actuating the tongs 10. In addition, a door 2 is pivotally mounted on a door hinge pin 3 to the housing 14 for opening and closing the joint entry slot 5 for allowing the entry and removal of the joint J.

Another feature of the present invention is the provision of an interlocking relationship between the door and the throttle to (1) prevent actuation of the throttle to an operating position until the door is in a fully closed position, and (2) to prevent the door from being open when the throttle is in a tong running position.

Referring now to FIG. 39, a base element 9 is fixed to the tong case 1 adjacent to the hinge pin 3 of the door 2. A "T" slotted slide bar 8 is slideably supported in the base element 9 and retained there by cover 10. The slide bar 9 is connected to and slideably moved by a rotation of the door 2 by means of a crank arm 4 connected to the door 2 which in turn is connected by pin 5 to a link 6 which in turn is connected by a pin 7 to the "T" slotted slide bar. Therefore, opening and closing of the door 2 will cause sliding movement of the slide bar, but if the slide bar 8 is prevented from movement by the throttle, the door cannot be opened.

The "T" slotted slide bar 8 includes a "T" slot including a head slot 8*a* and a tail slot 8*b*. The throttle knob 12*b* is connected to a throttle lever 12 which is pivotally movable about pin 13 and includes an extension 12*a* which extends into the key slot of the slide plate 8. With the door 2 closed, the throttle extension 12*a* will be positioned within the head slot 8*a* of the "T" and the throttle knob 12*b* may be actuated to rotate the lever 12 about the pin 13 and actuate the throttle rod 15 and the power as the throttle extension 12*a* may freely move from a neutral position aligned with the tail slot 8*b* to either a forward or reverse position in the head slot 8*a*. However, if the throttle lever 12 is in an other than vertical position (neutral) and thus positioned in one side or other of the head slot 8*a* the door 2 of the tong 10 cannot be opened since the slide bar will engage the throttle extension 12*a* and prevent movement of the slide bar 8 and door 2. Only when the throttle lever is in the vertical position (neutral) and aligned with the tail slot 8*b* can the door 2 be opened.

However, the lever 12 can be moved to the vertically centered neutral position in line with the tail 8*b*, the door 2 may be then opened rotating the crank arm 4, slideably moving the slide bar 8 and enclosing the vertically positioned throttle extension 12*a* with the tail slot 8*b*. Thereafter, there can be no movement of the throttle 12 until the door 2 is returned to the closed position.

MANUALLY ACTUATED VARIABLE DRIVE GEAR

Referring now to FIG. 40, a manual shift drive gear module is shown which can be manually shifted to change the output speed and thus the output torque. A compound planetary drive gear train is provided wherein speed change and consequently torque change is accomplished by shifting the sun gear power input shaft of a primary planetary train into planet gear engagement for speed reduction or into a keyed engagement with the planet arm for bypassing the primary train. Suitable rotative power is applied to a sun shaft 16 of the primary planetary train, either directly or by motor 81 through input pinion gear 12, idler gear 11, and gear 15, which is connected to the sun shafts 16. The primary or shifting planetary gear train includes the sun shaft 16, planet gears 25 mounted on a spindle 20, and stationary ring gear 26. The primary train is provided with a lockout cap 19 in which internal splines A are provided to receive the gear section B of sun shaft 16 after the gear section B is lifted clear of engagement with the planet gears 25. Shift knob 33 is connected to rod 2 for moving the sun shaft 16 from engagement with the planet gears 25 (low speed) to engagement with the lockout cap 19 (high speed) as desired.

In FIG. 40 the sun shaft 16 is shown in the low speed position with the sun shaft gears B engaging the planet gears 25 and rotating the spindle 20 at a low speed. Rotation of the spindle 20 connects the primary or shifting gear train to the planet gears 28 of the secondary planetary train which are integral with the output drive pinion 30. The second planetary gear train includes stationary ring gear 29, planet gears 28 and gears C on the pinion 20 which constitute the sun gear.

In order to shift the manual shift drive gear to high speed, the sun shaft 16 is raised to bring gears B into engagement with gears A on the lockout cap 19. The lockout cap 19 is then connected directly to the spindle 20 thereby bypassing primary planet gears 25, rotating secondary sun gear C and secondary planetary gears 28 through the top of spindle 20 which constitutes the planet arm of the primary train. Rotation of the secondary planet gears 28 causes rotational mounting of the planet arm of the secondary planet gears which are integral with the pinion gear 13 to provide the high speed drive output.

FRICTION SHIFT COMPOUND PLANETARY DRIVE MODULE

FIG. 42 illustrates a compound planetary drive gear chain, in which increased speed may be provided by energizing a friction lockout clutch between the ring gear and the planet arm of the primary train for bypassing the primary train. For speed reduction, a stationary clutch may be energized to lock the primary ring gear in a fixed position. Output speeds in either case will vary in a manner proportional to the slippage permitted by the clutch engagement.

Rotative power may be introduced to the sun gear shaft 11 either by a direct motor connection or by motor 10 through pinion gear 9, idler gear 8, and gear 7. The primary and shifting planetary gear train includes sun gear A on shaft 11 plane gears 13 on the planet arm section of spindle 34, and rotative ring gear 12. A first friction clutch 27 is provided between the housing 4 and the ring gear 12 and is actuated by a low speed piston 29 through hydraulic fluid ports 32. The application of hydraulic fluid through the port 32 acts upon the differential low speed piston 29 in a direction to increase the friction lockout clutch 27 for providing a low speed output from the primary planetary train.

For high speed rotation, a second friction clutch 24 is utilized instead of the first friction clutch 27. The second clutch 24 is energized by a hydraulic high speed piston 14 through hydraulic port 33. Application of hydraulic fluid through the port 33 acts upon the differential piston 14 to increase the friction on friction clutch 24 between the ring gear 12 and the planet gears 13 for bypassing the primary train.

In either operation, the spindle 20 provides a connection between the primary gear train to the secondary gear train and acts as the planet arm of the primary gear train. The secondary gear train includes sun gear B which is formed on the spindle 34, planet gears 38 and a fixed ring gear 36. Rotation of sun gear B causes rotation of the planetary gears 38 which are integrally connected to the output pinion 41 providing the output to the tongs.

TRANSDUCER SENSING DEVICE

A transducer assembly may be provided with a tong assembly to provide a pressure response proportional to the delivered torque of the tong and utilize the measured pressure response to hydraulically shift the hydraulically actuated friction clutch of FIG. 42. Referring now to FIG. 45, a transducer 1 is positioned in a fork 3 which in turn is connected by pivot pin 4 to the carrier plate 5 whereby torque applied to the jaws 8 on the joint 2 can be measured in either a clockwise or counterclockwise direction.

Referring now to FIG. 46, the transducer 1 includes a stationary body 10 having first and second pins 12 and 14 which engage the interior of the fork 3. Each of the pins 12 and 14 is connected to a piston 16 and 18, respectively, in a hydraulic cylinder 20 having hydraulic fluid therein. As the fork 3 is rotated in one direction or the other in response to an increase in torque, one of the pins 12 and 14 will be depressed inwardly increasing the pressure in the cylinder 20 in response to the applied torque of the tong. A hydraulic spool valve 2 is connected to an inlet line 3 and an outlet line 4 from a hydraulic power source. In addition, connections **33*a* and 32*a* are provided from the valve 2 to the ports 33 and 32, respectively, of the hydraulically actuated friction clutch of FIG. 42**.

In the position shown in FIG. 46, pin 12 has been depressed on the transducer 1 causing an increase in pressure in the hydraulic cylinder 20 to actuate the valve 2 whereby inlet pressure 3 is applied to line **32*a* and to port 32 to actuate piston 29 (FIG. 42*a*) to lock activate the primary gear train and decrease the outlet speed and increase the torque at spindle 23 while at the same time venting the fluid from port 33 through line 33*a* to deactivate piston 26 to deactuate friction clutch 27. In the event that the torque developed by the tong decreases, the pressure in the hydraulic cylinder 20 will decrease and the spring 34 will shift the spool valve 2 to the second position venting fluid from piston 29 through the port 32 and line 32*a*, through line 4 deactivating clutch 27 while applying hydraulic fluid pressure to port 33 will actuate piston 14 for engaging friction clutch 24** to lock out the primary train and establish the high speed, low torque mode.

What is claimed is:

1. In a tong having at least one jaw, each jaw pivotably connected to a link which link is pivotably connected to a rotary element and a drag plate connected to the rotary element for actuating the jaws, and brake means for engaging the drage plate, the improvement in brake means comprising, brake means engageable with the drag plate for causing toggle action for placing the jaws in a gripping relationship with a joint, and releasing means connected to the brake means for releasing the brake means when the jaws are in a seated gripping position.

2. The apparatus of claim 1 wherein the releasing means are responsive to the torque delivered by the at least one jaw.

3. The apparatus of claim 2 wherein the torque responsive means include a piston connected to a beam, the beam connected to the brake means, and the piston responsive to high pressure for moving the beam in a direction to disengage the brake, and spring means yieldably urging the piston out of engagement with the beam.

4. The apparatus of claim 3 wherein the torque responsive means includes a piston connected to the beam and responsive to moving the piston out of engagement with the beam when subjected to high pressure, and spring means acting against the piston in a direction to engage the piston with the beam and move the beam into a disengaging position as the pressure applied to the piston is lowered.

5. In a power tong having a housing, engaging jaws, power means for rotating the jaws, and an entry slot for allowing entry and removal of a joint from the tong, a door pivoted to the housing for opening and closing the entry slot, and throttle means for actuating the power means, the improvement comprising interlocking means connected between the door means and the throttle means for preventing actuation of the throttle means until the door is closed and preventing opening of the door until the throttle means is in a non-operating position, wherein the interlocking means includes a slideable T-slotted slide bar which is connected to the door by a crank arm and is movable in response to movement of the door and a throttle lever positioned in the T-slot.

6. A tong assembly for rotating a tubular member comprising, a housing, having a housing slot for receiving the tubular member, a carrier rotatably supported from the housing, the carrier having a carrier slot for receiving the tubular member, a power means interconnected with the carrier for rotating the carrier wherein the power means includes clutch means, and including a torque-responsive means connected between the backup tong and the power means for shifting the clutch means in response to torque change, and wherein the torque responsive means include a piston connected to a beam, the beam connected to the brake means, and the piston responsive to high pressure for moving the beam in a direction to disengage the brake, and spring means yieldably urging the piston out of engagement with the beam, at least one jaw for engaging and rotating the tubular member, a link pivotably connected to each jaw and to the carrier element, a backup tong for gripping and holding a joint and fixedly secured relative to the housing, a drag means connected to the carrier element and coacting with each jaw for moving each jaw relative to the tubular member, the drag means having a drag means slot for receiving the tubular member, and a brake means for engaging the drag plate and actuating each jaw.

7. A tong assembly for rotating a tubular member comprising, a housing, having a housing slot for receiving the tubular member, a carrier rotatably supported from the housing, the carrier having a carrier slot for receiving the tubular member, a power means interconnected with the carrier for rotating the carrier wherein the power means includes clutch means, and including a torque-responsive means connected between the backup tong and the power means for shifting the clutch means in response to torque change, and wherein the torque responsive means include a piston connected to a beam, the beam connected to the brake means, and the piston responsive to high pressure for moving the beam in a direction to disengage the brake, and spring means yieldably urging the piston out of engagement with the beam, the spring means acting against the piston in a direction to engage the piston with the beam and move the beam into a disengaging position as the pressure applied to the piston is lowered, at least one jaw for engaging and rotating the tubular member, a link pivotably connected to each jaw and to the carrier element, a backup tong for gripping and holding a joint and fixedly secured relative to the housing, a drag means connected to the carrier element and coacting with each jaw for moving each jaw relative to the tubular member, the drag means having a drag means slot for receiving the tubular member, and a brake means for engaging the drag plate and actuating each jaw.

8. A tong assembly for rotating a tubular member comprising, a housing, having a housing slot for receiving the tubular member, a carrier rotatably supported from the housing, the carrier having a carrier slot for receiving the tubular member, at least one jaw for engaging and rotating the tubular member, a link pivotably connected to each jaw and to the carrier element, a drag means connected to the carrier element and coacting with each jaw for moving each jaw relative to the tubular member, the drag means having a drag means slot for receiving the tubular member, a brake means for engaging the drag plate and actuating each jaw, and a throttle connected to a tong motor for actuating the carrier and a door pivotally connected to the housing for opening and closing an entry and exit slot for a tubular member in the housing and including interlocking engaging means between the throttle and the door for preventing actuation of the throttle unless the door is closed and preventing opening of the door until the throttle is placed in an unoperative position, wherein the interlocking means includes a slideable T-slotted slide bar which is connected to the door by a crank arm and a throttle lever positioned in the T-slot.

* * * * *